US006250844B1

(12) United States Patent
Sartler et al.

(10) Patent No.: US 6,250,844 B1
(45) Date of Patent: Jun. 26, 2001

(54) CONCRETE FINISHING TROWEL WITH IMPROVED ROTOR ASSEMBLY DRIVE SYSTEM

(75) Inventors: Ronald R. Sartler, West Bend; Peter J. Smith, Hartford; Steven D. Grant, Richfield, all of WI (US)

(73) Assignee: Wacker Corporation, Menomonee Falls, WI (US)

( * ) Notice: Subject to any disclaimer, the term of this patent is extended or adjusted under 35 U.S.C. 154(b) by 0 days.

(21) Appl. No.: 09/352,226

(22) Filed: Jul. 13, 1999

(51) Int. Cl.[7] ..... E01C 19/22
(52) U.S. Cl. ..... 404/112
(58) Field of Search ..... 404/112, 96, 97; 474/12, 17, 18, 37, 46, 8, 150

(56) References Cited

U.S. PATENT DOCUMENTS

| | | | | |
|---|---|---|---|---|
| 4,046,483 | | 9/1977 | Sutherland | 404/112 |
| 4,046,484 | | 9/1977 | Holz, Sr. et al. | 404/112 |
| 5,108,220 | | 4/1992 | Allen et al. | 404/112 |
| 5,480,258 | * | 1/1996 | Allen | 404/112 |
| 5,632,570 | | 5/1997 | Balling | 404/112 |
| 5,890,833 | | 4/1999 | Allen et al. | 404/112 |
| 5,934,823 | | 8/1999 | Allen . | |
| 5,967,696 | * | 10/1999 | Allen et al. | 404/112 |
| 6,106,193 | * | 8/2000 | Allen et al. | 404/112 |

OTHER PUBLICATIONS

Whiteman, HTH–Series Ride–On Power Trowels, Hydrostatic Drive—Hydraulic Steering, (1/97) 4 page brochure.
Whiteman, Ride–On Power Trowels, (WIROTFUL–562 Rev. A, (0397)) 4 page brochure. Mar. 1997.

* cited by examiner

*Primary Examiner*—Robert E. Pezzuto
(74) *Attorney, Agent, or Firm*—Boyle Fredrickson Newholm Stein & Gratz S.C.

(57) ABSTRACT

A concrete finishing trowel has one or more driven rotor assemblies coupled to an engine or other power source of the machine by a novel torque transfer system including at least one flexible shaft and possibly including a variable speed ratio torque converter assembly. The flexible shaft, preferably comprising a flexible wound wire shaft, bends to accommodate tilting movement of the associated rotor assembly that occurs upon a steering operation, thereby eliminating the need for high-maintenance universal joints or other, less durable equipment. The torque converter assembly, preferably taking the form of a pair of variable speed clutches each having variable diameter sheaves, permits the speed and torque ratios of the drive system to change with increases in engine speed so that the same machine can be effectively used for both low speed/high torque floating operations and for high speed burning operations. Multi-application use is further facilitated by moving the blades axially along their support arms to permit the blades to operate in either an overlapping mode or a non-overlapping mode.

31 Claims, 15 Drawing Sheets

CONCRETE FINISHING TROWEL WITH IMPROVED ROTOR ASSEMBLY DRIVE SYSTEM

BACKGROUND OF THE INVENTION

1. Field of the Invention

The invention relates to concrete finishing trowels which employ one or more rotatable blade-equipped rotor assemblies for finishing a concrete surface. More particularly, the invention relates to a concrete finishing trowel, such as a riding trowel, incorporating a torque transfer system for the rotor assembly or assemblies that has a variable speed ratio and that accommodates tilting of at least the driven shaft of the rotor assembly during a steering operation.

2. Description of the Related Art

A variety of machines are available for smoothing or otherwise finishing wet concrete. These machines range from simple hand trowels, to walk-behind finishing trowels, to self-propelled finishing trowels including some larger walk-behind machines as well as relatively large two-rotor or even three-rotor machines. Self-propelled finishing trowels, and particularly riding finishing trowels, can finish large sections of concrete more rapidly and efficiently than manually pushed finishing trowels. The invention is directed to self-propelled finishing trowels and is described primarily in conjunction with riding finishing trowels by way of explanation.

Riding concrete finishing trowels typically include a mobile frame including a deck. At least two, and sometimes three or more, rotor assemblies are mounted on an underside of the deck. Each rotor assembly includes a driven shaft extending downwardly from the deck and a plurality of trowel blades mounted on and extending radially outwardly from the bottom end of the driven shaft and supported on the surface to be finished. The driven shafts of the rotor assemblies are driven by one or more self-contained engines mounted on the frame and typically linked to the driven shafts by gearboxes of the respective rotor assemblies. The weight of the finishing trowel and the operator is transmitted frictionally to the concrete by the rotating blades, thereby smoothing the concrete surface. The individual blades usually can be tilted relative to their supports, via operation of a suitable mechanical lever and linkage system accessible by an operator seated on an operator's platform to alter the pitch of the blades, and thereby to alter the pressure applied to the surface to be finished by the weight of the machine. This blade pitch adjustment permits the finishing characteristics of the machine to be adjusted. For instance, in an ideal finishing operation, the operator first performs an initial "floating" operation in which the blades are operated at low speeds (on the order of about 30 rpm) but at high torque. Then, the concrete is allowed to cure for another 15 minutes to one-half hour, and the machine is operated at progressively increasing speeds and progressively increasing blade pitches up to the performance of a finishing or "burning" operation at the highest possible speed—preferably above about 150 rpm and up to about 200 rpm.

The blades of riding trowels can also be tilted, independently of pitch control for finishing purposes, for steering purposes. By tilting the driven shafts of the rotor assemblies, the operator can cause the forces imposed on the concrete surface by the rotating blades to propel the vehicle in a direction extending perpendicularly to the direction of driven shaft tilt. Specifically, tilting at least the driven shaft of the rotor assembly from side-to-side and fore-and-aft steers the vehicle in the forward/reverse and the left/right directions, respectively. It has been discovered that, in the case of a riding trowel having two rotor assemblies, the driven shafts of both rotor assemblies should be tilted for forward/reverse steering control, whereas only the driven shaft of one of the rotor assemblies needs to be tilted for left/right steering control.

The rotor assemblies of the typical riding finishing trowel are driven by a drive train that is connected directly to input shafts of the assemblies' gearboxes via a centrifugal clutch and a system of shafts, belts or chains, and other torque transfer elements of constant speed ratio. The drive trains also require universal joints to accommodate tilting of the gearbox relative to the remainder of the drive train during a steering control operation. The universal joints are expensive to maintain and must be maintained or replaced relatively frequently due to the ingress of concrete into the universal joints and their attendant bearings.

Another problem associated with traditional rotor assembly drive systems is that they exhibit an insufficient speed range for both low speed/high torque floating operations and high speed burning operations. The typical drive system includes a simple centrifugal clutch of a constant speed ratio. Hence, blade speed increases at least generally proportionately with engine speed from zero to a maximum speed, with torque decreasing commensurately over that same engine speed range. No known concrete finishing trowel has a constant speed ratio clutch that can obtain both the necessary low speed/high torque combination required for optimal floating operations and the high speed required for optimal burning operations. Hence, many contractors keep two machines at each job site—one having a relatively low speed ratio and configured for floating operations, and one having a relatively high speed ratio and configured for burning operations. This requirement significantly increases the expense of a particular finishing operation.

The above-identified problems associated with drive systems having traditional centrifugal clutches can be alleviated if the traditional centrifugal clutch is replaced with a hydrostatic drive system, as is the case in the HTS-Series Ride on Power Trowel marketed by Whiteman Corp. of Carson, Calif. However, hydrostatic drive systems still exhibit a less than optimal speed/torque range. They are also relatively expensive and heavy when compared to more traditional, mechanical-clutch operated drive systems. The hydraulic components of these hydrostatic systems are also prone to failure and leakage.

Applicants are aware of one attempt to alleviate these problems by using a variable speed ratio torque converter assembly to transfer torque from the engine to the rotor assemblies of a riding concrete finishing trowel. Specifically, Bartell Corp. proposed the use of a torque converter assembly to permit the speed ratio of a concrete finishing trowel's rotor assemblies to change during the operation of the machine. The torque converter assembly included drive and driven variable-speed clutches that operated in conjunction with one another so that, as the engine accelerated, the relative diameters of the sheaves of the drive and driven clutches changed to increase the machine's speed ratio as the engine speed increased. However, testing revealed that the clutches of this torque converter assembly were improperly sized and configured. As a result, the desired effect of providing a single machine capable of operating at low rpm and high torque and high rpm and low torque was not achieved.

OBJECTS AND SUMMARY OF THE INVENTION

It is therefore a first principal object of the invention to provide a concrete finishing trowel that includes a reliable, low-maintenance torque transfer system for coupling the driven rotor assembly or assemblies of the machine to the machine's engine or other power source.

Another object of the invention is to provide a concrete finishing trowel that meets the first principal object and that includes a torque transfer system which is relatively immune to damage from the ingress of wet concrete or other materials.

In accordance with a first aspect of the invention, these objects are achieved by eliminating the universal joint of a traditional rotor assembly drive system in favor of a flexible drive shaft that can bend to accommodate tilting of the rotor assembly driven shaft (or the gearbox if the flexible shaft is coupled to the driven shaft via an intervening gearbox) during a steering control operation. The flexible shaft, preferably comprising a flexible wound wire shaft, requires no universal joints and is maintenance free.

Another object of the invention is to provide a concrete finishing trowel that meets the first principal object and that can change speed ratios so as to permit the same machine to be used effectively for both low speed/high torque operations and high speed/low torque operations.

Another object of the invention is to provide a concrete finishing trowel that meets at least the first principal object and that does not require expensive, heavy, and leak-prone hydraulic systems to increase the machine's speed range.

In order to increase the effective operational range of the machine, a variable speed ratio torque converter assembly is preferably used to couple, at least indirectly, the driven shafts of the rotor assemblies to the engine. The torque converter assembly is configured such that it has a low speed ratio and high torque ratio at low engine speeds and exhibits progressively higher speed ratios as the engines input speed increases. Preferably, the torque converter assembly includes drive and driven clutches that are connected to one another by a belt or the like and that each has a sheave of variable effective diameter. At initial clutch engagement, the effective diameter of the drive clutch sheave is very small (due to the fact that the axial width of the drive sheave is maximized), and the diameter of the driven clutch sheave is very large (due to the fact that axial width of the driven sheave is minimized), resulting in a low speed/high torque ratio and yielding the lowest rotor speed and highest rotor torque. As the engine speed increases, the drive sheave begins to narrow axially, causing the drive sheave effective diameter to increase and tightening the drive belt. Drive belt tightening forces the driven sheave components apart so that the driven sheave widens axially, thereby causing the effective diameter of the driven sheave to decrease and increasing the speed ratio. Ultimately, the effective diameter of the drive sheave becomes very large, and the effective diameter of the driven sheave becomes very small, resulting in a very high speed ratio. As a result, a single machine can be used to perform both low speed/high torque floating operations and high speed burning operations.

Another principal object of the invention is to improve the versatility of a concrete finishing machine by permitting the diameter of the circular areas finished by the rotor assemblies of a multi-rotor assembly machine to be varied to meet the needs of a particular application.

In accordance with another aspect of the invention, this object is achieved by mounting the blades of each of the machine's rotor assemblies on the associated driven shaft such that the diameter of each of the circular areas is adjusted by changing a radial spacing between ends of the blades and the associated driven shaft. Preferably, each rotor assembly comprises a plurality of support arms which extend radially outwardly from the driven shaft and on which the trowel blades are mounted, and the trowel blades are mountable on multiple axial locations on the support blades so as to alter the diameter of the circular area. If the finishing trowel has a pair of rotor assemblies, the first and second rotor assemblies are dimensionally adjustable to adjust the diameter of the circular areas finished by the rotor assemblies to permit the finishing trowel to be operated in either an overlapping mode or a non-overlapping mode.

Another principal object of the invention is to provide an improved method of transferring torque from an engine or other power source of a concrete finishing trowel to one or more rotor assemblies of the machine using equipment that is simple, inexpensive, and reliable.

In accordance with another aspect of the invention, these objects are achieved by transferring torque from a power source, such as the output shaft of an internal combustion engine, to a shaft which is flexible along at least a substantial portion of the entire length thereof, then transferring torque from the flexible shaft to a driven shaft of a rotor assembly of the finishing trowel, and then, during the torque transfer operation, repeatedly tilting the driven shaft with respect to the frame of the finishing trowel, thereby causing the flexible shaft to dynamically and repeatedly bend during torque transfer.

The flexible shaft preferably comprises a wire wound flexible shaft and typically will be connected directly to the input shaft of the gearbox of the rotor assembly. Preferably, the flexible shaft is coupled to the gearbox input shaft or another shaft to which it is attached so as to permit relative axial movement therebetween occurring upon tilting of the rotor assembly during a steering control operation.

Another object of the invention is to provide a method that meets the second principal object and that permits the machine to be used through a wide range of speeds and torques so as to permit the same machine to be used for both high torque/low speed operations and high speed operations.

The machine can be operated so as to perform a low speed/high torque floating operation and a high speed burning operation using the same machine. As a result, torque is transmitted to each rotor assembly of the machine so as to rotate at speeds of less than 50 rpm, and preferably on the order of 30 rpm, during a floating operation and at over 150 rpm, and preferably on the order of 200 rpm, during a burning operation. In addition, the blades can be moved along their arms so as to operate in either an overlapping mode or a non-overlapping mode.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a concrete finishing trowel is provided having one or more driven rotor assemblies coupled to an engine or other power source of the machine by a novel torque transfer system including at least one flexible shaft and possibly including a variable speed ratio torque converter assembly. The flexible shaft, preferably comprising a flexible wound wire shaft, bends to accommodate tilting movement of the associated rotor assembly that occurs upon a steering operation, thereby eliminating the need for high-maintenance universal joints or other, less durable equipment. The torque converter assembly, preferably taking the form of a pair of variable speed clutches each having variable diameter sheaves, permits the speed and torque ratios of the drive system to change with increases in engine speed so that the same machine can be effectively used for both low speed/high torque floating operations and for high speed burning operations. Multi-application use is further facilitated by moving the blades axially along their support arms to permit the blades to operate in either an overlapping mode or a non-overlapping mode.

2. System Overview

The present invention is applicable to any power concrete finishing trowel that is steered by tilting of the rotor assembly or rotor assemblies of the trowel. Hence, while the invention is described herein primarily in conjunction with a riding finishing trowel having two counter-rotating rotor assemblies, it is not so limited.

Figure 1:
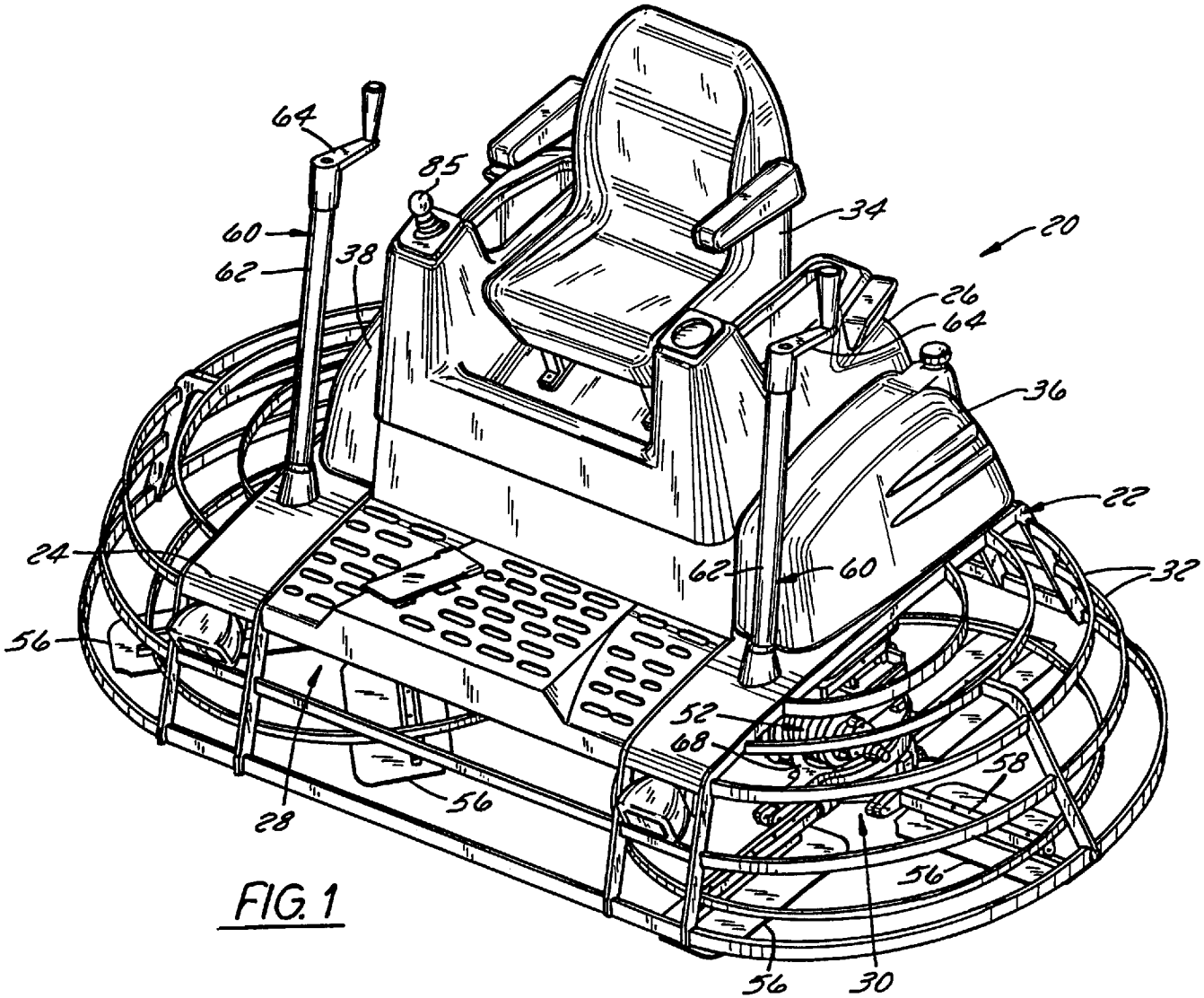
FIG. 1 is a perspective view of a riding concrete finishing trowel constructed in accordance with a preferred embodiment of the invention.

Referring now to FIGS. 1–6 and initially to FIG. 1 in particular, a riding concrete finishing trowel 20 in accordance with a preferred embodiment of the invention includes as its major components a rigid metallic frame 22, an upper deck 24 mounted on the frame, an operator's platform or pedestal 26 provided on the deck, and right and left rotor assemblies 28 and 30, respectively, extending downwardly from the deck 24 and supporting the finishing machine 20 on the surface to be finished. The rotor assemblies 28 and 30 rotate towards the operator, or counterclockwise and clockwise, respectively, to perform a finishing operation. A conventional ring guard 32 is positioned at the outer perimeter of the machine 20 and extends downwardly from the deck 24 to the vicinity of the surface to be finished. The pedestal 26 is positioned longitudinally centrally on the deck 24 at a rear portion thereof and supports an operator's seat 34. The pedestal 26 and seat 34 can be pivoted via hinges (not shown) to permit access to components of the machine located thereunder, such as the machine's engine 72. A fuel tank 36 is disposed adjacent the left side of the pedestal 26, and a water retardant tank38 see FIG. 1 is disposed on the right side of the pedestal 26 and overlies one of the actuators 86 of a steering system 76 detailed below.

Figure 2:
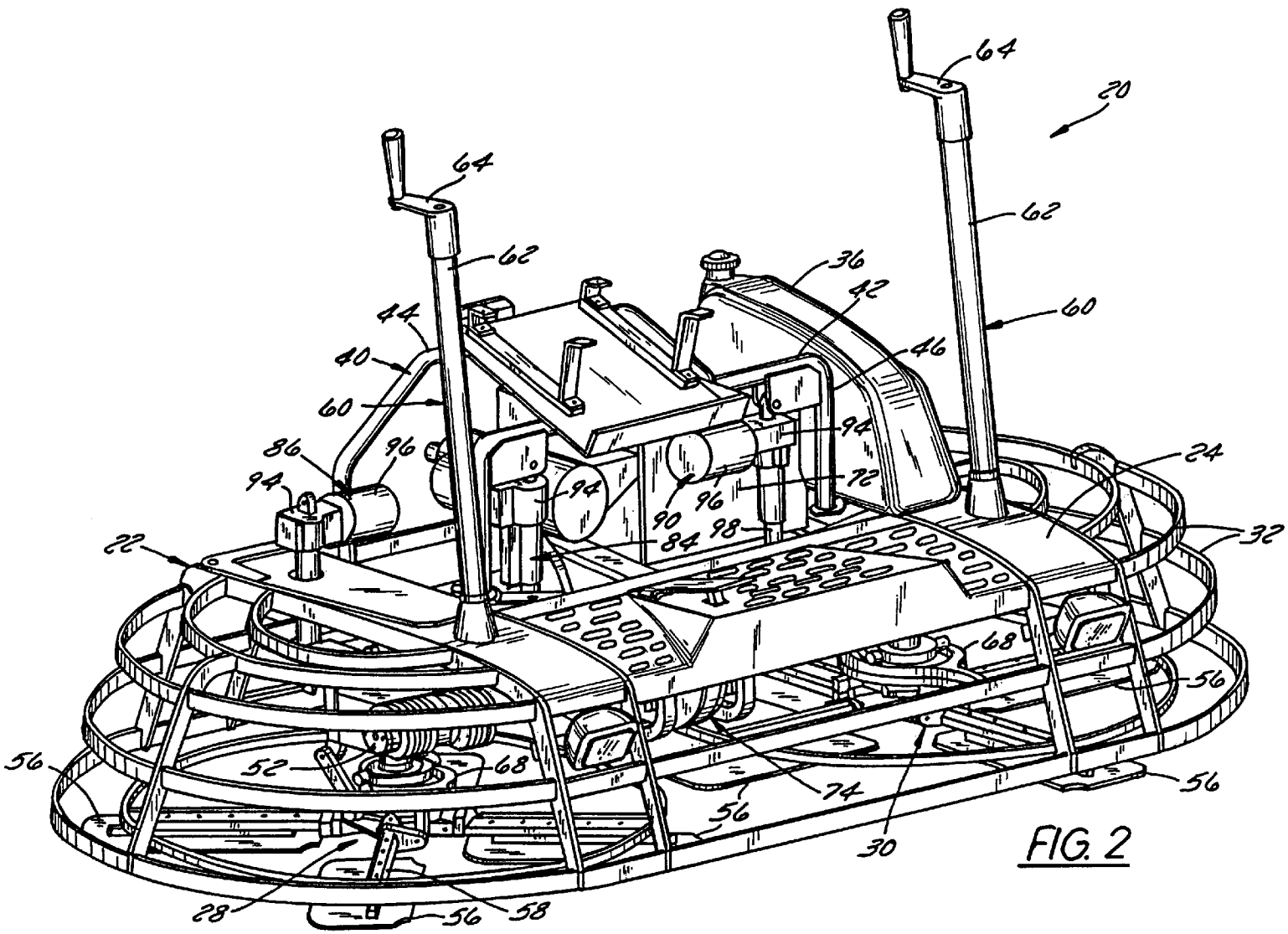
FIG. 2 corresponds to FIG. 1 and illustrates the finishing trowel with the operator's seat and adjacent shrouds removed.
Figure 5:
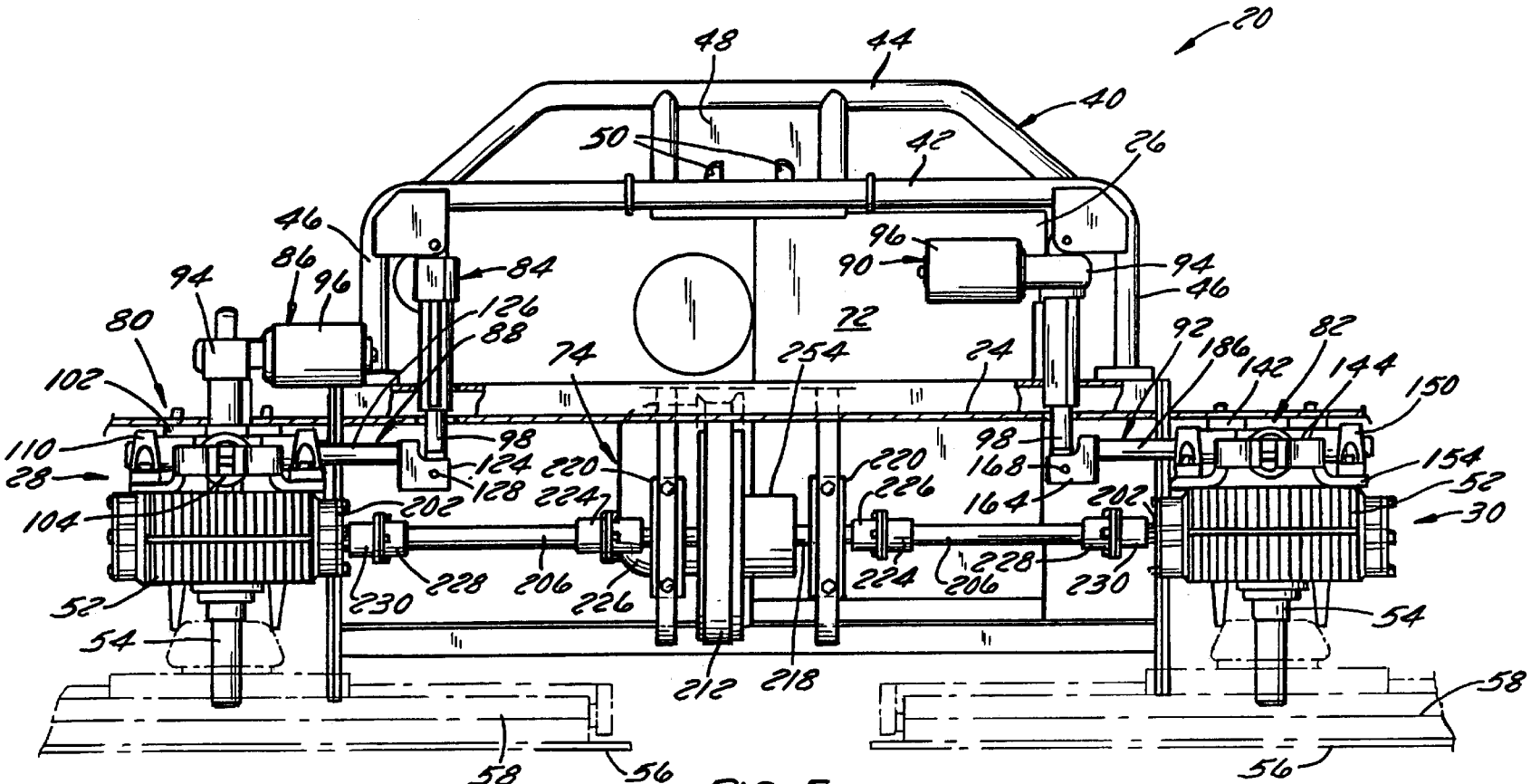
FIG. 5 is a partially fragmentary, partially schematic sectional end elevation view of the finishing trowel.
Figure 6:
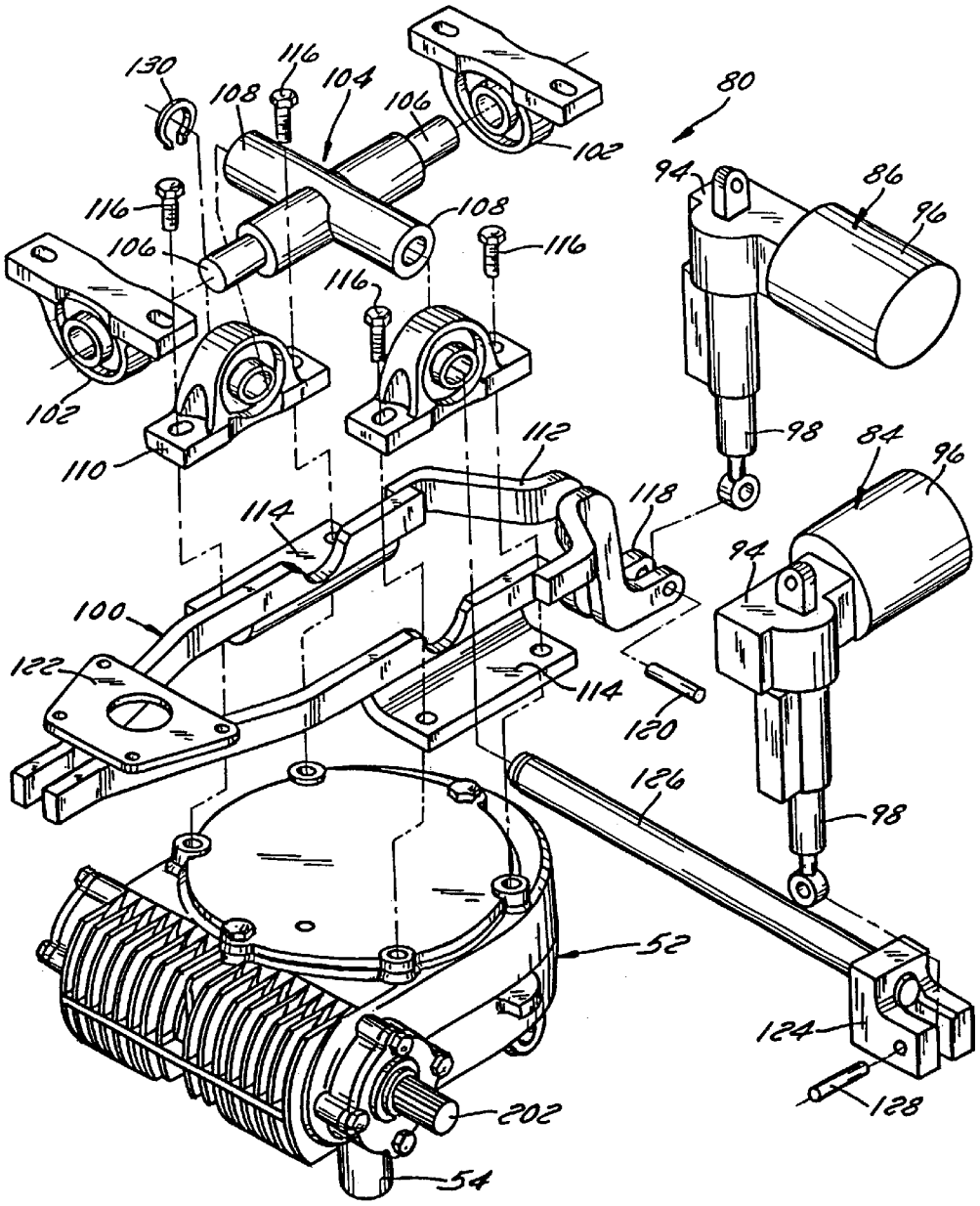
FIG. 6 is a partially exploded, perspective view of the right rotor assembly of the finishing trowel, along with the associated steering linkage and actuators.
Figure 8:
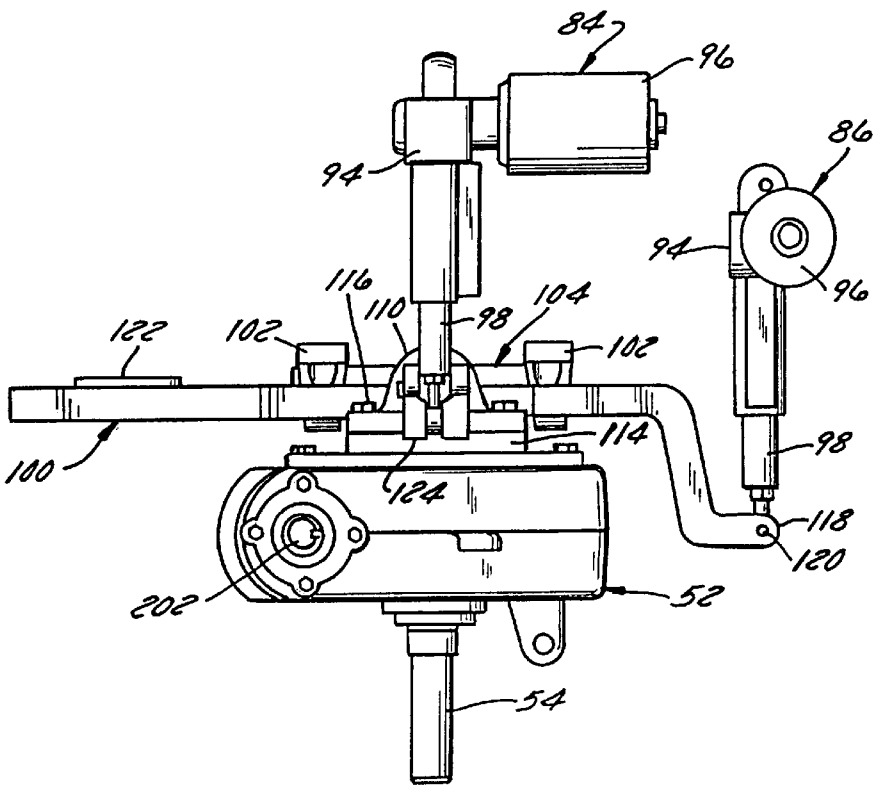
FIG. 8 is a side elevation view of the assembly of FIGS. 6 and 7.
Figure 7:
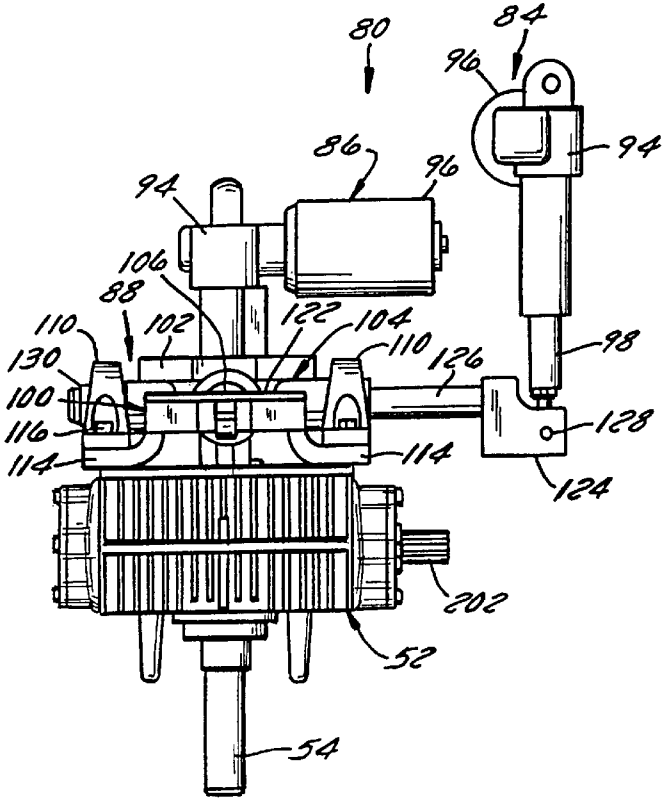
FIG. 7 is a front elevation view of the assembly of FIG. 6.
Figure 9:
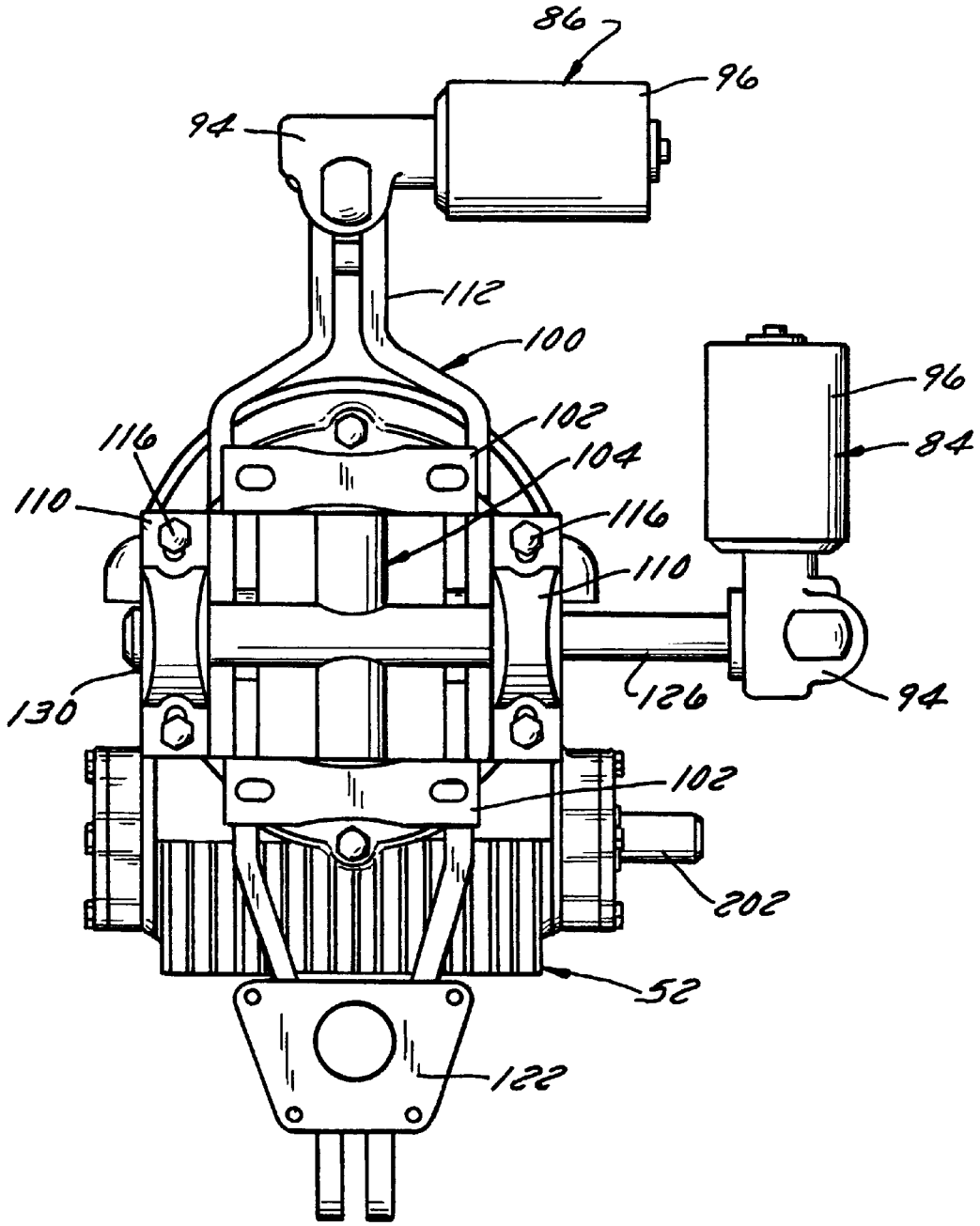
FIG. 9 is a top plan view of the assembly of FIGS. 6–8.
Figure 10:
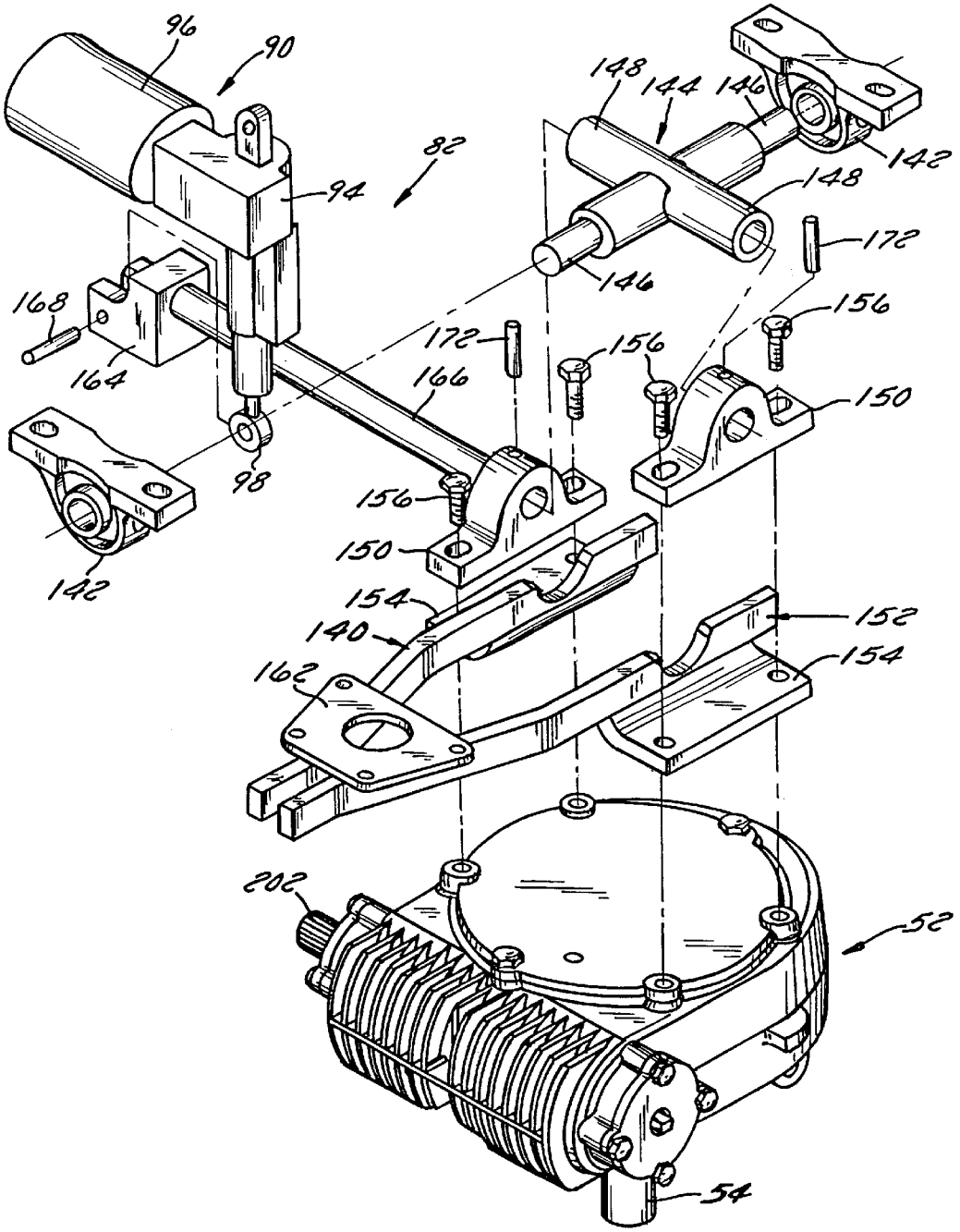
FIG. 10 a partially exploded perspective view of the left rotor assembly of the machine, along with the associated steering linkage and actuator.
Figure 11:
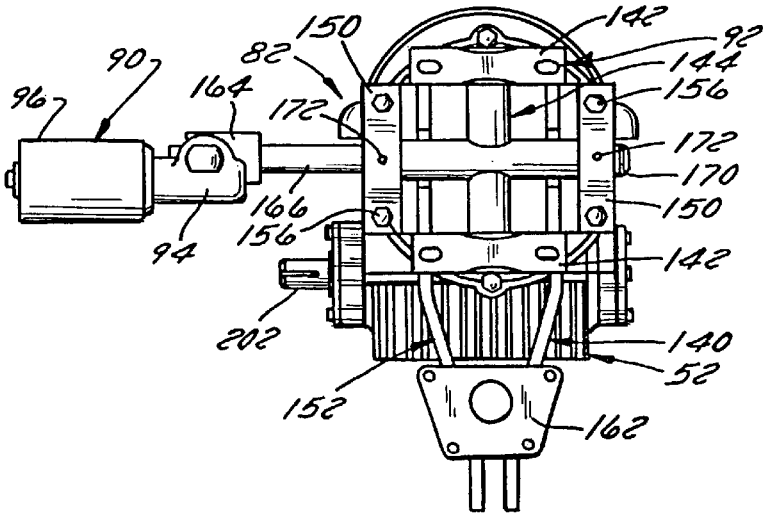
FIG. 11 is a top plan view of the assembly of FIG. 10.
Figure 12:
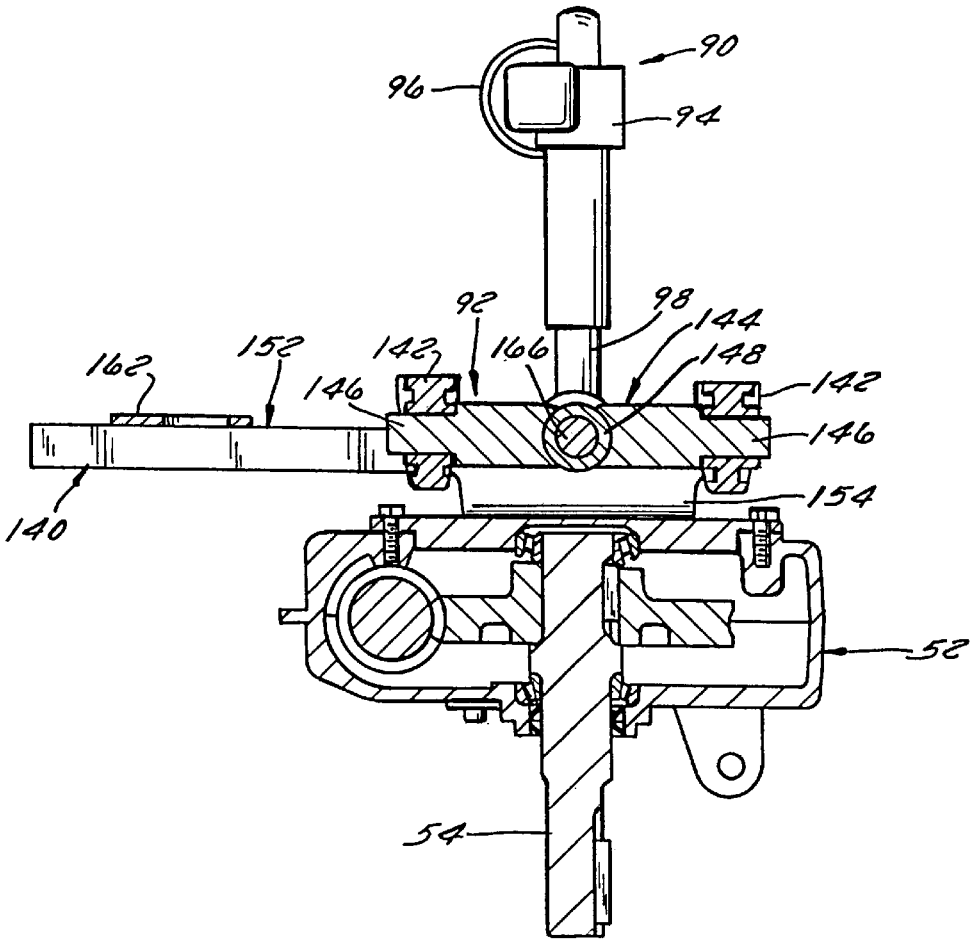
FIG. 12 is a sectional side elevation view of the assembly of FIGS. 10 and 11.

A lift cage assembly 40, best seen in FIGS. 2 and 5, is attached to the upper surface of the deck 24 beneath the pedestal 26 and seat 34. The lift cage assembly 40 is formed from a plurality of interconnected steel tubes including front and rear generally horizontal tubes 42 and 44 spaced above the deck 24 by vertical support tubes 46 positioned at the ends of the generally horizontal tubes 42 and 44. The front and rear generally horizontal tubes 42 and 44 are connected to one another by a plate 48 that has D-shaped cutouts 50 (FIG. 5) to provide a central lifting location for receiving a hook or the like. The cutouts 50 are positioned such that the entire machine 20 can be lifted from a central lift point, thereby eliminating the need for a harness or a four-point type attachment usually used to lift machines of this type for transport.

Figure 3:
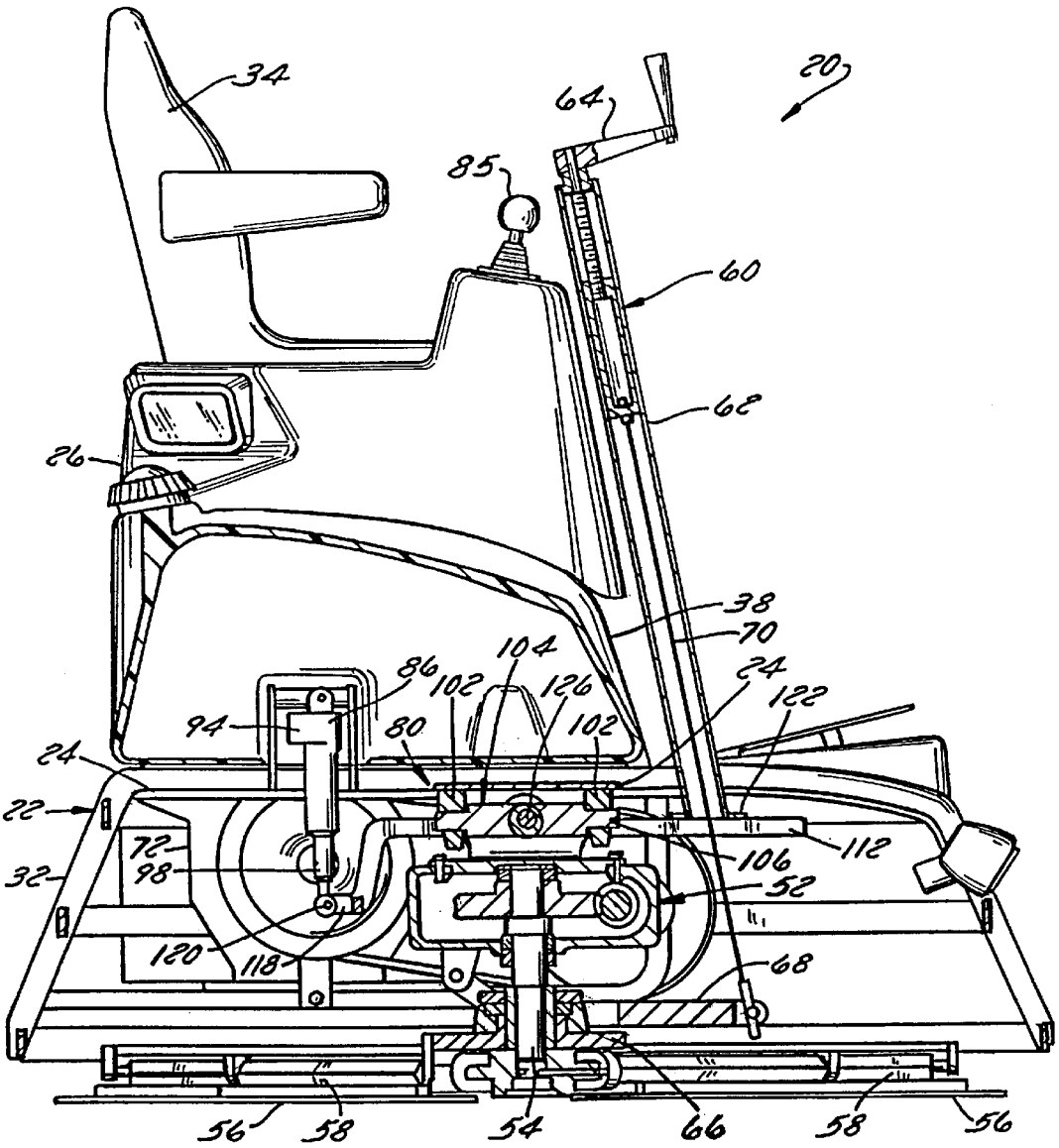
FIG. 3 is a right side sectional elevation view of the finishing trowel, taken through the right rotor assembly of the machine.
Figure 4:
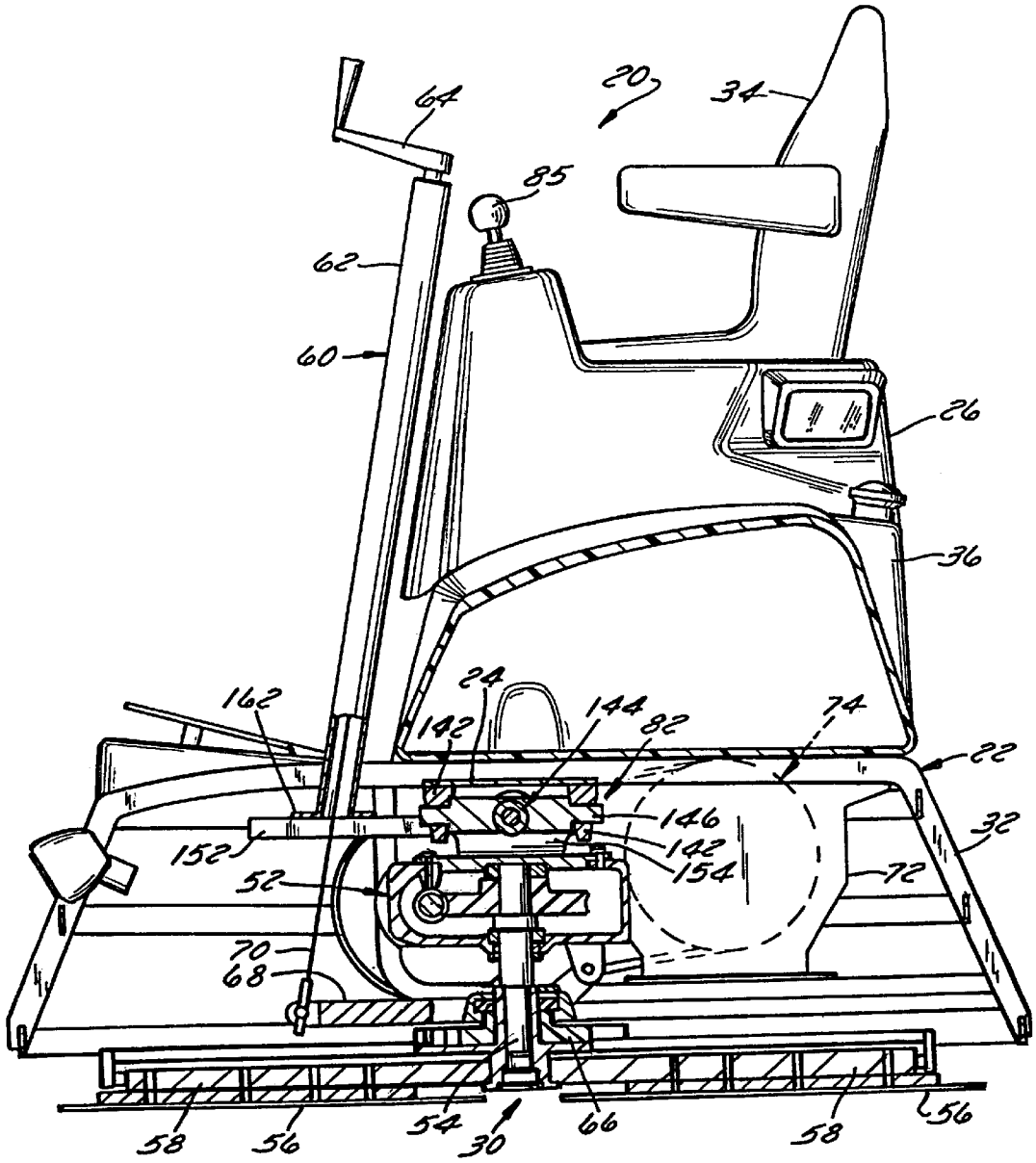
FIG. 4 is a left side sectional elevation view of the finishing trowel, taken through the left rotor assembly of the machine.

Referring now to FIGS. 3–5, each rotor assembly 28, 30 includes a gearbox 52, a driven shaft 54 extending downwardly from the gearbox, and a plurality of circumferentially-spaced blades 56 supported on the driven shaft 54 via radial support arms 58 and extending radially outwardly from the bottom end of the driven shaft 54 so as to rest on the concrete surface. Each gearbox 52 is mounted on the undersurface of the deck 24 so as to be tiltable about the deck 24 for reasons detailed below.

The pitch of the blades 56 of each of the right and left rotor assemblies 28 and 30 can be individually adjusted by a dedicated blade pitch adjustment assembly, generally designated 60 in FIGS. 1–4. Each blade pitch adjustment assembly 60 includes a generally vertical post 62 and a crank 64 which is mounted on top of the post 62, and which can be rotated by the operator to vary the pitch of the trowel blades 56. In the typical arrangement, a thrust collar 66 cooperates with a yoke 68 that is movable to force the thrust collar 66 into a position pivoting the trowel blades 56 about an axis extending perpendicular to the axis of the driven shaft 54. A tension cable 70 extends from the crank 64, through the post 62, and to the yoke 68 to interconnect the yoke 68 with the crank 64. Rotation of the crank 64 adjusts the yoke's angle to move the thrust collar 66 up or down thereby providing a desired degree of trowel blade pitch adjustment. A power concrete finishing trowel having this type of blade pitch adjustment assembly is disclosed, e.g., in U.S. Pat. No. 2,887,934 to Whiteman, the disclosure of which is hereby incorporated by reference.

Both rotor assemblies 28 and 30, as well as other powered components of the finishing trowel 20, are driven by a power source such as a gasoline powered internal combustion engine 72 mounted under the operator's seat 34. The size of the engine 72 will vary with the size of the machine 20 and the number of rotor assemblies powered by the engine. The illustrated two-rotor, 48" machine typically will employ an engine of about 25 hp. The rotor assemblies 28 and 30 are connected to the engine 72 via a unique torque transfer system 74 (FIGS. 15–17) and can be tilted for steering purposes via a unique steering system 76 (FIGS. 6–14). The steering system 76 and torque transfer system 74 will now be described in turn.

3. Steering System

As is typical of riding concrete finishing trowels of this type, the machine 20 is steered by tilting a portion or all of each of the rotor assemblies 28 and 30 so that the rotation of the blades 56 generates horizontal forces that propel the machine 20. The steering direction is perpendicular to the direction of rotor assembly tilt. Hence, side-to-side and fore-and-aft rotor assembly tilting cause the machine 20 to move forward/reverse and left/right, respectively. The most expeditious way to effect the tilting required for steering control is by tilting the entire rotor assemblies 28 and 30, including the gearboxes 52. The discussion that follows therefore will describe a preferred embodiment in which the entire gearboxes 52 tilt, it being understood that the invention is equally applicable to systems in which other components of the rotor assemblies 28 and 30 are also tilted for steering control.

More specifically, the machine 20 is steered to move forward by tilting the gearboxes 52 laterally to increase the pressure on the inner blades of each rotor assembly 28, 30 and is steered to move backwards by tilting the gearboxes 52 laterally to increase the pressure on the outer blades of each rotor assembly 28, 30. Side-to-side steering requires tilting of only one gearbox (the gearbox 52 of the right rotor assembly 28 in the illustrated embodiment), with forward tilting of the gearbox 52 increasing the pressure on the front blades of the rotor assembly 28 to steer the machine 20 to the right. Similarly, rearward tilting of the gearbox 52 increases the pressure on the back blades of the rotor assembly 28 to steer the machine 20 to the left.

The steering system 76 tilts the gearboxes 52 of the right and left rotor assemblies 28 and 30 using right and left steering assemblies 80 and 82 controlled by a controller 85. The right steering assembly 80, best seen in FIGS. 5–9 includes a first or right actuator arrangement and a first or right steering linkage 88 coupling the right actuator arrangement to the gearbox 52 of the right rotor assembly 28. Similarly, the left steering assembly 82, best seen in FIGS. 10–12, includes a second or left actuator arrangement and a second or left steering linkage 92 coupling the second actuator arrangement to the gearbox 52 of the left rotor assembly 30. The first actuator arrangement includes both a forward/reverse actuator 84 and a left/right actuator 86, whereas the second actuator arrangement includes only a forward/reverse actuator 90. The controller 85 preferably is coupled the actuators 84, 86, and 90 so that manipulation of the controller 85 in a particular direction steers the machine 20 to move in that same direction, preferably at a speed that is proportional to the magnitude of controller movement.

The actuators 84, 86, and 90 extend vertically through the deck 24 of the concrete finishing trowel 20 and are attached directly or indirectly to the frame 22, e.g., by attachment to the deck 24 and/or to the lift cage assembly 40 as best seen in FIGS. 2–5. Each actuator may comprise any electrically-operated device that selectively receives energizing current from the controller 85 in the form of electrical steering command signals and translates those command signals into linear movement of the output of the actuator and resultant pivoting of the associating steering linkage 88 or 92. The actuators 84, 86 and 90 preferably are of the type that have internal feedback potentiometers which compare the actual position of the actuator's output with the commanded position transmitted by the controller 85. When those positions match, actuator motion stops, and the actuator holds its output in that position. Suitable actuators comprise ball-screw actuators available, e.g., from Warner Electric of South Beloit, Ill. These actuators are bi-directional, versatile, relatively low-cost, and feedback controlled. Each actuator 84, 86, or 90 includes 1) a stationary base 94 extending above the deck 24 and fixed to the deck or another stationary component of the machine 20, 2) an electric motor 96, and 3) a linearly-displaceable rod 98. The rod 98 is driven by a ball screw drive, which provides precise positioning and high load carrying capacity. For instance, an actuator of this type can provide saddle speeds up to 49" per second and drive axial loads up to 900 lbs. The preferred actuator has a force rating of approximately 500 lbs., though lighter-duty actuators could be used if the steering linkages 88 and 92 were to be replaced by more complex lever assemblies. It should be emphasized, however, that ball-screw actuators of this type are not essential to the invention and that other electrically-powered actuators could be used in their stead.

Each of the left and right steering linkages 88 and 92 will now be described in turn.

Referring to FIGS. 3 and 5–9, the right steering linkage 88 includes a steering bracket 100 and a pivoting support assembly mounting the steering bracket 100 on the deck 24 for biaxial pivoting movement with respect thereto. The pivoting support assembly includes first and second pairs of pillow block bearings 102 and 110, and a cross tube 104. The first pair of pillow block bearings 102 is bolted to the bottom of the deck 24. The cross tube 104 has 1) opposed longitudinal ends 106 journaled in the pillow block bearings 102 and 2) opposed lateral ends 108 disposed adjacent the second pair of pillow block bearings 110. The steering bracket 100 includes a frame 112 extending longitudinally of the machine 20 and a pair of mounting plates 114 extending laterally from the frame 112. The steering bracket 100 and gearbox 52 are fixed to the second pair of pillow block bearings 110 by bolts 116 extending through holes in the pillow block bearings 110, through mating holes in the mounting plates 114, and into tapped bores in the top of the gearbox 52. By this arrangement, the steering bracket 100 (and, hence, the gearbox 52) 1) pivots about a lateral axis of the cross tube 104 to effect fore-and-aft tilting of the gearbox and, accordingly, left/right steering and 2) pivots about a longitudinal axis of the cross tube 104 to effect side-to-side gearbox tilting and, accordingly, forward/reverse steering control. To enable gearbox pivoting about the cross tube's longitudinal axis, a longitudinal end of the frame 112 of the steering bracket terminates in a clevis 118 which is coupled to the output of the left/right actuator 86 by a pivot pin 120. In the illustrated embodiment, the opposite end of the frame 112 presents a mounting plate 122 for the blade pitch adjustment post 62 (see FIG. 3), thereby assuring that the blade pitch adjustment assembly 60 moves with the gearbox 52 and that a steering control operation therefore does not affect blade pitch. To enable gearbox pivoting about the cross tube's lateral axis, the output of the forward/reverse actuator 84 is pivotably connected to a clevis 124 of a pivot lever 126 via a pivot pin 128. The lever 126 extends through the second pair of pillow block bearings 110, through the lateral ends of the cross tube 104, and is held in place by a retaining ring 130.

Turning now to FIGS. 2, 4, 5 and 10–12, the left steering assembly 82 differs from the right steering assembly 80 only in that it is configured to pivot only side-to-side for forward/reverse steering operation. As a result, the clevis at the longitudinal end of its steering linkage 92 can be eliminated, along with the left/right actuator 86. In addition, the second set of bearings 110 can be replaced with simple supports 150. The left steering linkage 92 is otherwise identical to the right steering linkage and includes a steering bracket 140 and pivoting support assembly. The pivoting support assembly includes 1) pillow block bearings 142 and 2) a cross tube 144 having longitudinal ends 146 and lateral ends 148. The steering bracket 140 includes a frame 152 and a pair of mounting plates 154 extending laterally from the frame 152 and connected to the supports 150 and the gearbox 52 via bolts 156. The post 62 of the associated blade pitch adjustment assembly 60 is mounted on a mounting plate 162 mounted on one end of the frame 152. The output of the forward/reverse actuator 90 is coupled to a clevis 164 of pivot lever 166 by a pivot pin 168. The pivot lever 166 extends through the supports 150, through the lateral ends 148 of the cross tube 144, and is fixed to the supports 150 by spring pins 172 so that the gearbox 52 and frame 22 can pivot laterally about the longitudinal axis of the cross tube 144 but are fixed from longitudinal pivoting about the lateral axis.

Figure 13:
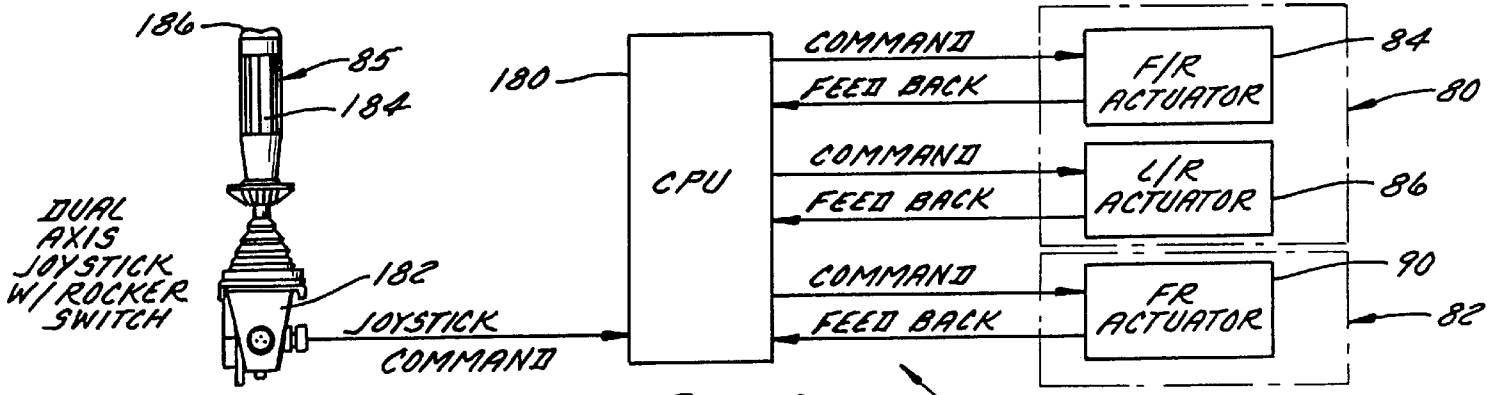
FIG. 13 is a schematic illustration of the electronic control components of a steering control system constructed in accordance with a first preferred embodiment of the invention.

The controller can be any device translating physical operator movements into electronic steering command signals. Turning now to FIG. 13, one preferred controller 85 for generating steering command signals and transmitting the steering command signals to the actuators 84, 86, and 90 is a dual-axis, proportional control joystick that is electronically coupled to the actuators via a programmed CPU 180. The above-mentioned feedback capability of the actuators 84, 86, and 90 permits them to interface with the CPU 180 to correlate actuator motion with joystick motion. As a result, the appropriate actuator 84, 86, or 90 moves in the direction commanded by the joystick 85 through a stroke that is proportional to the magnitude of joystick movement. The machine 20 therefore moves in the direction of joystick movement at a speed that is proportional to the magnitude of joystick movement. For instance, to steer the concrete finishing machine 20 to move forwardly, the joystick 85 is pivoted forwardly about its fore-and-aft axis, and the CPU 180 controls both forward/reverse actuators 84 and 90 to extend or retract their output rods through a stroke that is proportional to the degree of joystick movement, hence driving the gearboxes 52 to pivot laterally toward or away from each other by an amount that causes the machine 20 to move straight forward or rearward at a speed that is proportional to the magnitude of joystick movement. Similarly, joystick movement from side-to-side about its second axis generates a steering command signal that is processed by the CPU 180, in conjunction with the feedback potentiometers on the left/right actuator 86, to extend or retract the output rod of that actuator 86 so as to tilt the associated gearbox 52 forwardly or rearwardly by an amount that is proportional to the magnitude of joystick movement and that results in finishing machine movement to the right or left at a speed that is proportional to the magnitude of joystick movement. If the joystick 85 is released and, accordingly, returns to its centered or neutral position under internal biasing springs (not shown), each of the actuators 84, 86, and 90 also returns to its centered or neutral position.

Still referring to FIG. 13, the joystick 85 includes a stationary base 182 and a grip 184 that is mounted on the base 182 and that is pivotable as described above. A rocker switch 186 is mounted on the grip 184 and is operable when depressed to energize both forward/reverse actuators 84 and 90 simultaneously (but in opposite directions) so as to effect either clockwise or counterclockwise turning of the machine 20, depending upon the direction of rocker switch displacement. Preferably, the rocker switch 186 is configured such that the machine 20 turns clockwise when the rocker switch 186 is pivoted to the right and counterclockwise when the rocker switch 186 is pivoted to the left.

Figure 14:
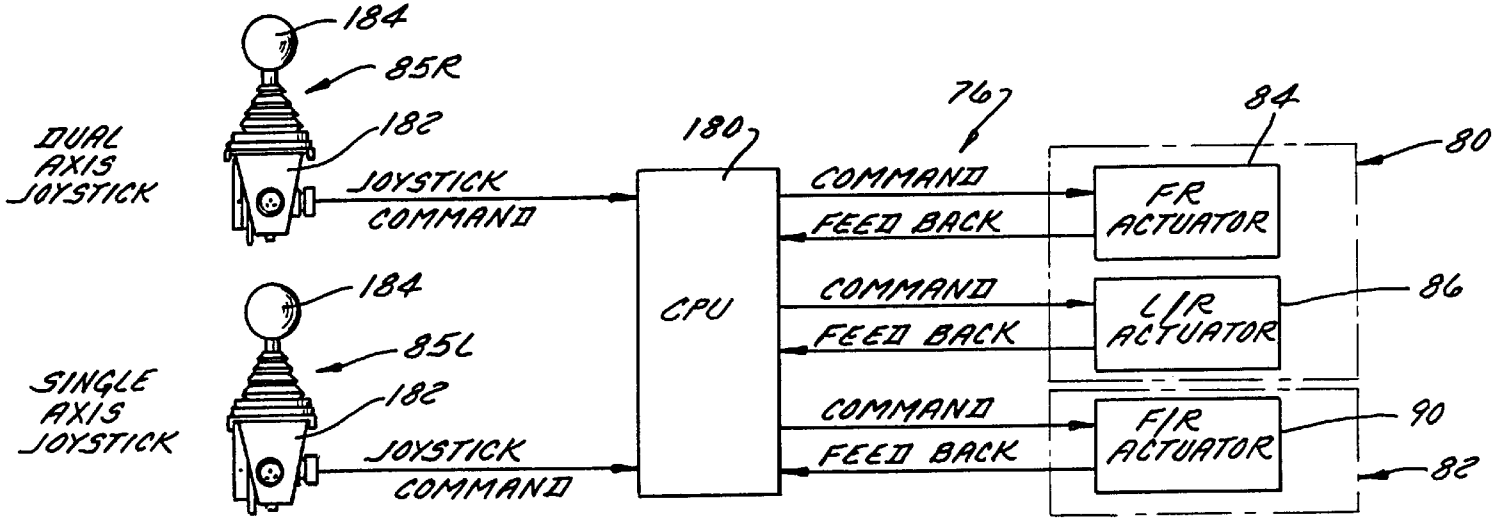
FIG. 14 is a schematic illustration of the electronic control components of a steering control system constructed in accordance with a second preferred embodiment of the invention.
Figure 15:
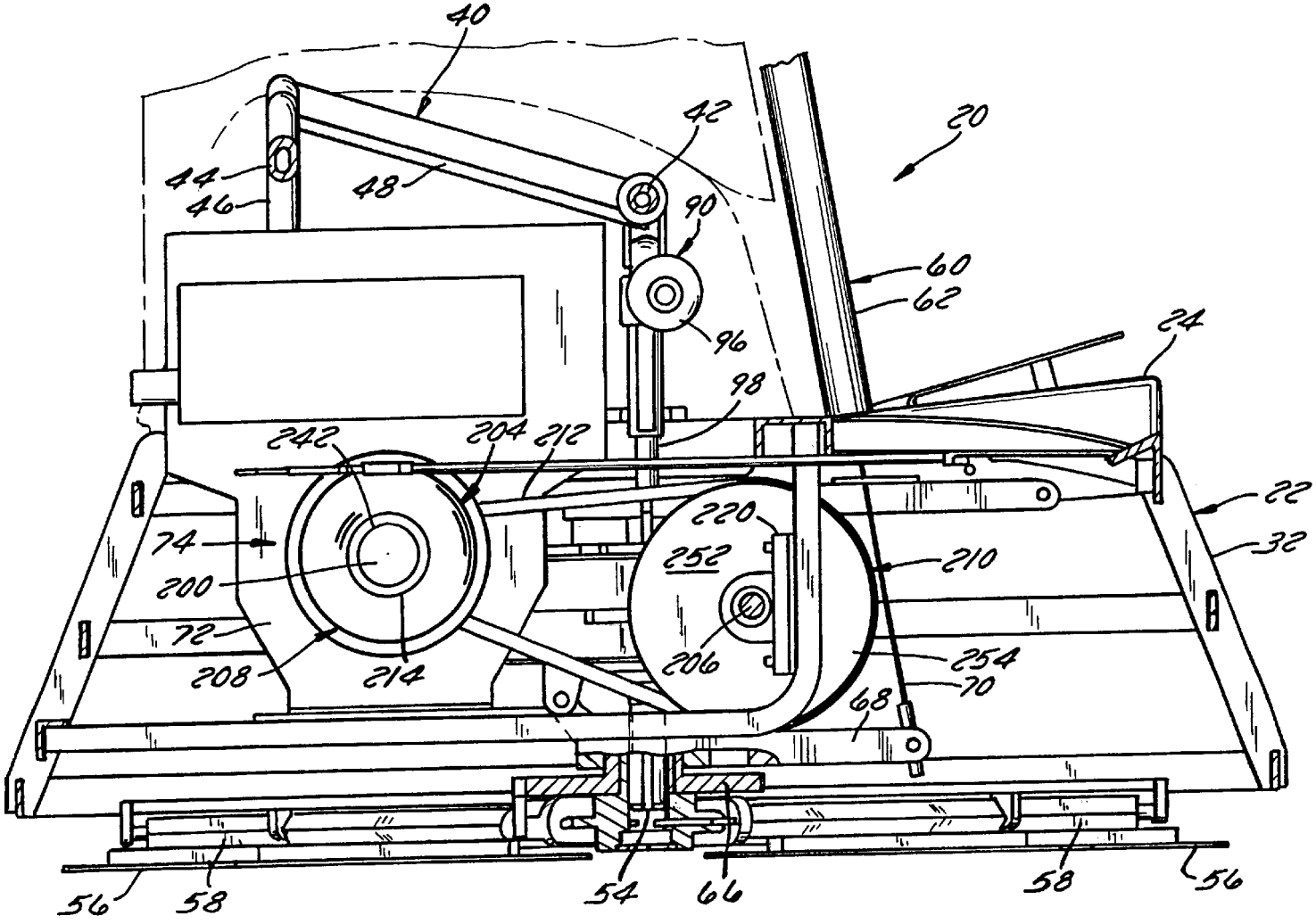
FIG. 15 is a sectional side elevation view of the finishing trowel, illustrating a torque transfer system of the machine.

As an alternative to the above-described arrangement, the single dual-axis joystick 85 of FIG. 13 can be replaced with two joysticks 85R and 85L as illustrated in FIG. 14, one of which (85R) is a dual-axis joystick suitable for both forward/reverse and left/right steering control and the other of which (85L) is a single-axis joystick which is pivotable only fore-and-aft to effect only forward/reverse steering control. The rocker switch is eliminated from this embodiment. Some operators might prefer this arrangement because it, like the conventional mechanical lever arrangements with which they are acquainted, uses a dedicated controller for each rotor assembly.

The above-described power steering system 76 exhibits many advantages over traditional mechanically operated systems and even over hydrostatically operated systems. For instance, it is much easier to operate than mechanically-operated systems, with the only forces required of the operator being the relatively small forces (on the order of less than 1–2 lbs) needed to overcome the internal spring forces of the joystick(s). In addition, much simpler mechanical linkages are required to couple the actuators 84, 86, and 90 to the gearboxes 52 than are required to couple mechanically-operated control levers to the gearboxes of earlier systems. Moreover, unlike hydrostatically steered systems, the machine 20 is relatively lightweight and does not risk high-pressure fluid spills.

4. Torque Transfer System

Referring now to FIGS. 15–18, the torque transfer system 74 is designed to transfer drive torque from an output shaft 200 of the engine 72 to the input shafts 202 of the gearboxes 52 so as to drive the rotor assemblies 28 and 30 to rotate. Significant novel features of the torque transfer system 74 include 1) its ability to change speed ratios and/or blade assembly diameters so as to permit the machine 20 to perform markedly different finishing operations and 2) its elimination of the need for a complex universal joint while still accommodating tilting movement of the driven shafts 202 of the gearboxes 52 relative to the engine output shaft 200. These two goals are achieved using 1) a variable speed ratio torque converter assembly 204 (FIG. 16), and 2) flexible drive shafts 206 (FIG. 17), respectively.

Figure 16:
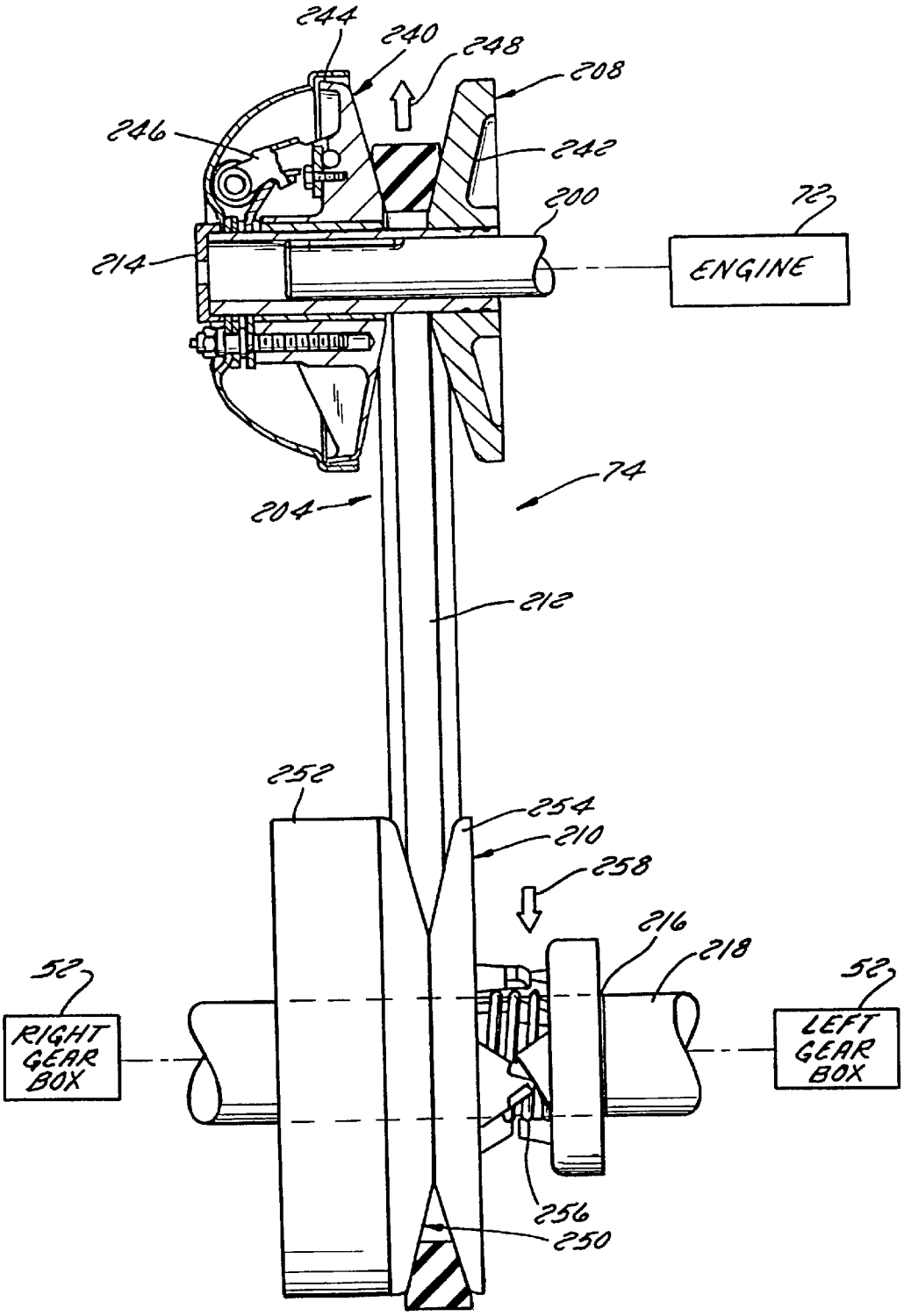
FIG. 16 is a partially fragmentary, partially schematic top plan view of the torque transfer system of FIGS. 14 and 15.

The torque converter assembly 204 includes variable speed drive and driven clutches 208 and 210 coupled to one another by a torque transfer element, preferably a belt 212. A hub 214 of the drive clutch 208 is keyed to the engine output shaft 200 (which may be either the actual output shaft of the engine 72 or another output shaft coupled directly or indirectly to the engine's output shaft) as illustrated in FIG. 16. Similarly, a hub 216 of the driven clutch 210 is keyed to a jackshaft 218 so that the jackshaft rotates with the driven clutch 210. The jackshaft 218 is supported on the frame 22 by pillow block bearings 220 and has output ends 222 that are coupled to the respective left and right flexible shafts 206.

Figure 17:
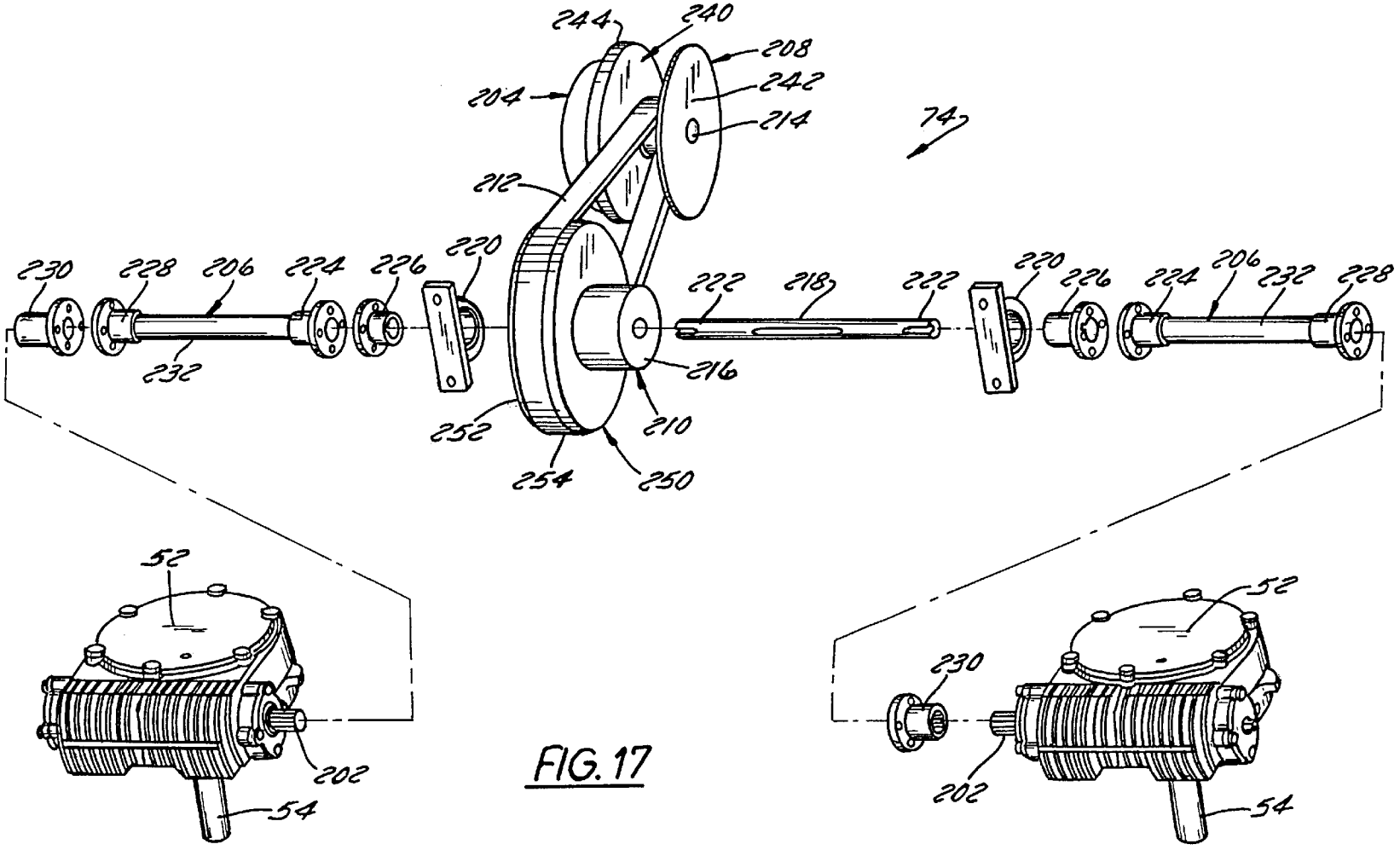
FIG. 17 is an exploded perspective view of the torque transfer system of FIGS. 14–16.

The flexible shafts 206 are coupled to both the jackshaft 218 and to the input shafts 202 of the gearboxes 52. Specifically, and as can be seen in FIG. 17, each of the flexible shafts 206 is fixed to an associated output end 222 of the jackshaft 218 via a coupling 226 pressed into the associated bearing 220. An input end of each coupling 226 is keyed to an associated output end 222 of the jackshaft 218, and an output end of each coupling 226 is bolted to a fitting 224 swagged onto the input end of the associated flexible shaft 206. Another fitting 228, swagged onto an output end of each of the flexible shafts 206, is coupled to the associated gearbox input shaft 202 by an internally splined coupling 230 bolted to the fitting 228. The splined fitting 230 permits relative axial movement between the flexible shaft 206 and the gearbox input shaft 202 during gearbox tilting. If desired, this relative movement could also be achieved by permitting axial movement between the flexible shaft 206 and the jackshaft 218.

As discussed briefly above, flexible shafts are used as the shafts 206 in order to accommodate tilting of the left and right gearboxes 52 relative to the jackshaft 218 without requiring complex universal joints. Each shaft 206 is formed from materials that permit it to bend along at least a substantial portion of the entire length thereof, typically all but at the ends and, while retaining sufficient torsional stiffness to permit the shaft 206 to drive the input shaft of the associated gearbox 52. The shafts 206 need not bend a great deal because the gearboxes 52 only tilt a few degrees (less than 10° and typically on the order of 4°) in operation. However, and unlike most applications in which flexible shafts of this type are used, the shafts 206 bend dynamically (i.e., while they are transmitting torque) and repeatedly during operation of the machine 20. A wound wire flexible shaft, often used in weed eaters and other equipment exhibiting a convoluted fixed path between the drive motor and the driven shaft, has been found to work well for this purpose. The illustrated shaft is in the range of 1' long and 1" in diameter. If desired, a sleeve 232, formed from rubber or some other moisture and dirt proof material, can be fitted around the wound wire of the shaft 206 to protect it. A suitable wound wire shaft is available, e.g., from Elliott Manufacturing Company of Binghamton, N.Y.

The torque converter assembly 204 is preferably of the variable speed ratio type available, e.g., from Comet Industries. As best seen in FIGS. 16 and 17, drive clutch 208 includes the aforementioned hub 214 and a variable width sheave 240. The sheave 240 includes a first portion 242 fixed to the hub 214 and a second portion 244 slidably mounted on the hub 214 so as to be axially movable towards and away from the first portion 242. The second portion 244 is biased away from the first portion 242 by a spring (not shown) and movable axially towards the first portion 242 under the action of a plurality of centrifugal cams 246. The inner axial faces of the first and second portions 242 and 244 are angled toward one another from the outer to inner radial ends thereof so that the effective radial diameter of the sheave 240 (corresponding to the location on the sheave 240 that is substantially the same width as the belt) varies inversely with the axial spacing between the first and second portions 242 and 244. Accordingly, as the speed of the engine output shaft 200 increases, the centrifugal cams 246 force the second portion 244 towards the first portion 242 to decrease the effective axial width of the sheave 240. The effective radial diameter of the sheave 240 therefore increases as the belt rides upwardly along the sheave in the direction of arrow 248 in FIG. 16.

The driven clutch 210 also has a variable diameter sheave 250, but the diameter of the sheave 250 varies inversely with the diameter of the sheave 240 of the drive clutch 208. Specifically, the sheave 250 of the driven clutch includes a first portion 252 fixed to the hub 216 and a second portion 254 mounted on the hub 216 so as to be axially movable towards and away from the first potion 252. The second portion 254 is biased towards the first portion 252 by a spring 256. As with the drive clutch, the inner axial faces of the first and second portions 252 and 254 are angled toward one another from the outer to inner radial ends thereof so that the effective radial diameter of the sheave 250 varies inversely with the axial spacing between the first and second portions 252 and 254. Accordingly, as the belt 212 moves outwardly along the sheave 240 of the drive clutch 208 during engine acceleration, the increased tension compresses the spring 256 to widen the axial gap between the first and second sheave portions 252 and 254 to reduce the effective diameter of the driven sheave 250. As a result, the belt 210 rides inwardly in the direction of arrow 258 in FIG. 16. The effective speed ratio of the torque converter assembly 204 therefore progressively increases upon engine acceleration, and progressively decreases upon engine deceleration as the reverse affect occurs. This permits the rotor assemblies 28 and 30 to be driven through a speed/torque range that varies dramatically with engine speed.

Figure 18:
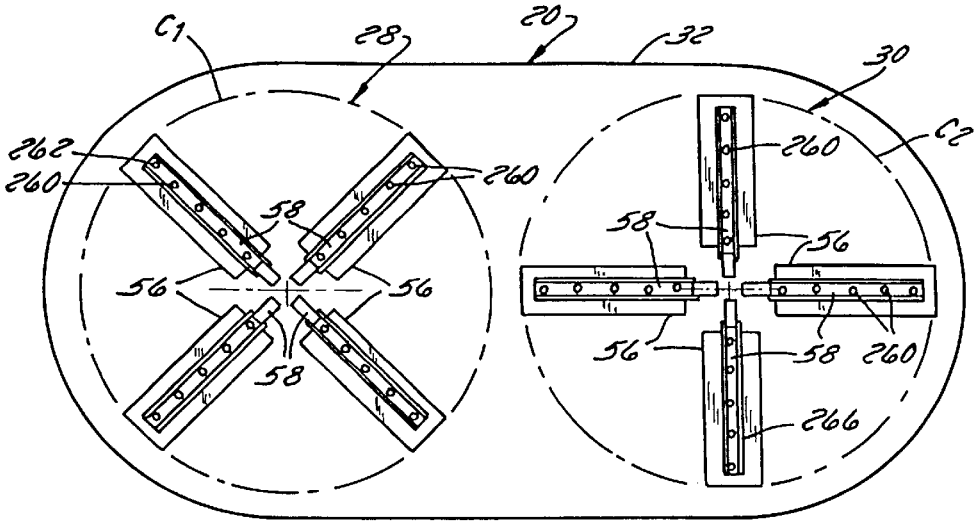
FIG. 18 is a bottom plan view of the finishing trowel with its blades configured for non-overlapping operation.
Figure 19:
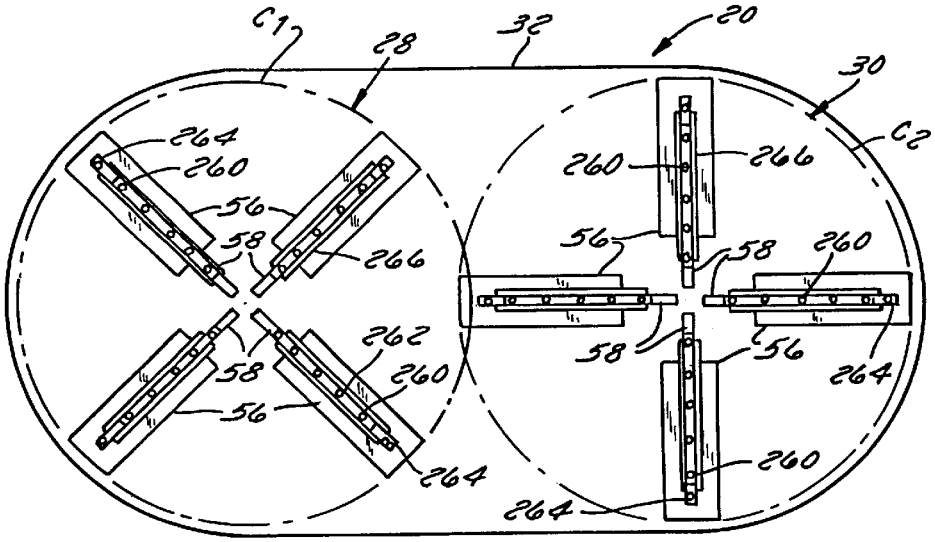
FIG. 19 is a bottom plan view of the finishing trowel with its blades configured for overlapping operation.
Figure 18A:
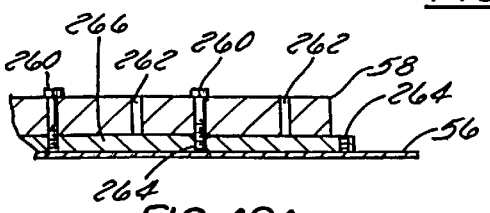
FIG. 18A is a fragmentary sectional elevation view of a portion of a rotor assembly of the finishing trowel configured as illustrated in FIG. 18.
Figure 19A:
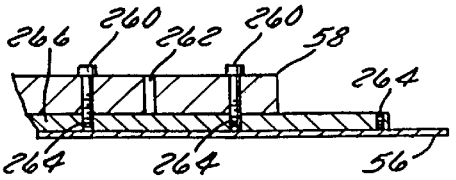
FIG. 19A is a fragmentary sectional elevation view of a portion of a rotor assembly of the finishing trowel configured as illustrated in FIG. 19.

The invention takes advantage of this capability by being capable of operating in both overlapping and non-overlapping modes using the same machine 20. Specifically, as best seen in FIGS. 18, 18A, 19, and 19A, the trowel blades 56 are mounted on their associated support arms 58 by bolts 260 that extend through bores 262 spaced axially along the support arms 58 and into tapped bores 264 in mounting brackets 266 for the blades 56. The support arms 58 are long enough and have enough mounting bores 262 to permit the blades 56 to be fixed to different points along the arms 58 so as to permit the trowel blades 56 to be mounted either 1) inwardly along the support arms 58 so that the two circles C1 and C2 circumscribing the blades 56 of the rotor assemblies 28 and 30 do not overlap, as seen in FIGS. 18, and 18A; or 2) outwardly along the support arms 58 so that the two circles C1 and C2 circumscribing the blades 56 of the rotor assemblies 28 and 30 overlap, as seen in FIGS. 19 and 19A. When the blades 56 are in their non-overlapping positions illustrated in FIGS. 18, and 18A, a circular pan (not shown) can be clipped onto the bottoms of the blades 56 of each of the rotor assemblies 28 and 30 to permit the machine 20 to perform a floating operation.

The finishing machine 20 can be used for virtually any finishing operation. For instance, to perform a so-called "floating" operation whose goal is to rough-finish freshly poured concrete as soon as the concrete sets enough to be finished, the blades 56 are mounted on the inner portions of the support arms 58 so that the circles C1 and C2 circumscribing each set of blades 56 do not overlap, as shown in FIGS. 18 and 18A, a pan (not shown) may then be clipped onto the blades 56 of each rotor assembly 28 or 30, and the finishing machine 20 is then steered over the concrete surface with the engine 72 being run at a low speed. At this time, the sheaves 240 and 250 of the drive and driven clutches 208 and 210 of the torque converter assembly 204 exhibit their minimum and maximum diameters, respectively (or diameters close to those minimum and maximum) to effect maximum speed change. As a result, high torque is transferred to the blades at low rpms—less than 50 rpm and typically on the order of 30 rpm. Alternatively, the blades 56 can be positioned further out along the support arms to a position in which the circles C1 and C2 overlap, as seen in FIGS. 19 and 19A. The operator can then steer the machine 20 over the concrete surface at different engine speeds and different blade pitches. The speed ratio of the torque converter assembly 204 increases as the engine speed increases, thereby permitting the rotor assemblies 28 and 30 to be driven at a higher speed than would otherwise be possible. The finishing machine 20 can even be used in so-called "burning operations," in which the blade pitch is maximized and the blades 56 are rotated at a high speed of more than 150 rpm and preferably on the order of about 200 rpm. Hence, a single concrete finishing machine 20 can be used for the entire finishing operation, including very low speed/high torque floating operations and very high speed burning operations, and the same blades 56 can be used for both non-overlapping and overlapping finishing operations. No previously-known machine has this degree of versatility.

The gearboxes 52 are tilted almost continuously during the finishing operations to effect the desired steering control. This tilting results in repeated, dynamic bending of the flexible shafts 206. It has been found that the shafts 206 require considerably less maintenance and have a much longer life than universal joints, while being impervious to damage from the wet concrete.

Many changes and modifications could be made to the invention without departing from the spirit thereof. Some of these changes, such as its applicability to riding concrete finishing trowels having other than two rotors and even to other self-propelled powered finishing trowels, are discussed above. Other changes will become apparent from the appended claims.

We claim:

1. A concrete finishing trowel comprising:

(A) a mobile frame;

(B) a rotor assembly which is supported on said frame and which includes a driven shaft and a plurality of trowel blades attached to and extending outwardly from said driven shaft so as to rest on a surface to be finished and to rotate with said driven shaft to finish a circular area;

(C) a power source which is supported on said frame and which is coupled to a rotatable output shaft; and (D) a torque transfer system which transfers torque from said output shaft to said driven shaft, said torque transfer system including a flexible shaft which has an input end operatively coupled to said output shaft and an output end which is operatively coupled to said driven shaft, said flexible shaft being flexible through at least a substantial portion of an entire length thereof to accommodate bending thereof upon a steering operation which results in tilting of said driven shaft.

2. A finishing trowel as defined in claim 1, wherein said flexible shaft is a wound wire flexible shaft.

3. A finishing trowel as defined in claim 1, wherein said torque transfer system further comprises a torque converter having an input coupled to said output shaft and having an output coupled to said input end of said flexible shaft.

4. A finishing trowel as defined in claim 3, wherein said torque converter includes a drive clutch coupled to said output shaft, a driven clutch coupled to said input of said flexible shaft, and a belt coupling said drive clutch to said driven clutch, wherein each of said clutches has a variable-width sheave which changes in effective diameter as a rotational speed thereof increases.

5. A finishing trowel as defined in claim 4, wherein, as the rotational speed of said output shaft increases, said sheave of said drive clutch increases in effective diameter and said sheave of said driven clutch decreases in effective diameter, thereby increasing a speed ratio of said torque converter.

6. A finishing trowel as defined in claim 4, wherein said power source comprises an internal combustion engine and wherein said output shaft is driven by said engine and is keyed to a hub of said drive clutch, and wherein said torque transfer system further comprises a jackshaft which is fixed to a hub of said driven clutch and which has an output end which is coupled to said input end of said flexible shaft so as to prevent relative rotation therebetween.

7. A finishing trowel as defined in claim 1, wherein said rotor assembly further comprises a gearbox from which said driven shaft extends and which tilts relative to said frame during a steering operation, said gearbox having an input shaft which is operatively coupled to said output end of said flexible shaft.

8. A finishing trowel as defined in claim 1, wherein said flexible shaft is coupled to at least one of an input element and an output element so as to accommodate axial movement therebetween.

9. A finishing trowel as defined in claim 1, wherein the diameter of said circular area is alterable.

10. A finishing trowel as defined in claim 9, wherein said rotor assembly further comprises a plurality of support arms which extend radially outwardly from said driven shaft and on which said trowel blades are mounted, and wherein said trowel blades are mountable on multiple axial locations on said support arms so as to alter the diameter of said circular area.

11. A finishing trowel as defined in claim 1, further comprising 1) a steering linkage which is operatively coupled to said rotor assembly so as to tilt said driven shaft relative to said frame upon movement of said steering linkage relative to said frame, 2) an electric actuator which is coupled to said steering linkage and which is selectively actuatable to translate said steering linkage so as to tilt said driven shaft relative to said frame, and 3) a manually operated controller which is electronically coupled to said actuator and which is selectively operable to energize said actuator so as to tilt said driven shaft relative to said frame and to steer said finishing trowel.

12. A finishing trowel as defined in claim 1, wherein said finishing trowel is a riding trowel of which said rotor assembly is a first rotor assembly which finishes a first circular area, and further comprising a second rotor assembly which is spaced from said first rotor assembly and which includes a second driven shaft and a plurality of trowel blades attached to and extending outwardly from said second driven shaft so as to rest on the surface to be finished and to rotate with said second driven shaft to finish a second circular area.

13. A finishing trowel as defined in claim 12, wherein said torque transfer system further comprises a second flexible shaft which has an input end which is operatively coupled to said output shaft and an output end which is operatively coupled to said second driven shaft, said second flexible shaft being flexible through at least a substantial portion of an entire length thereof to accommodate bending thereof relative to said input end thereof upon a steering operation which results in tilting of said second driven shaft.

14. A finishing trowel as defined in claim 12, wherein said first and second rotor assemblies are dimensionally adjustable to vary the diameters of said first and second circular areas to permit said finishing trowel to be operated in either an overlapping mode or a non-overlapping mode.

15. A finishing trowel as defined in claim 1, said finishing trowel further comprising:

a deck which is mounted on said mobile frame;

an operator's pedestal positioned on said deck; and an operator's seat supported by said pedestal; wherein said pedestal and said seat are hingedly attached to said deck to permit access to components of said finishing trowel located thereunder.

16. A concrete finishing trowel comprising:

(A) a mobile frame; and (B) at least two rotor assemblies which are supported on said frame and each of which includes a driven shaft and a plurality of trowel blades supported on and extending outwardly from said driven shaft so as to rest on a surface to be finished and to rotate with said driven shaft to finishing a circular area, and wherein a diameter of at least one of said circular areas is adjustable by changing a radial spacing between ends of the blades of the associated rotor assembly and the driven shaft of the associated rotor assembly so that the circular areas finished by said rotor assemblies can be adjusted so that they either overlap or do not overlap.

17. A finishing trowel as defined in claim 16,further comprising:

a deck which is mounted on said mobile frame;

an operator's pedestal positioned on said deck; and an operator's seat supported by said pedestal; wherein said pedestal and said seat are hingedly attached to said deck to permit access to components of said finishing trowel located thereunder.

18. A finishing trowel as defined in claim 16, wherein each said rotor assembly further comprises a plurality of support arms which extend radially outwardly from the associated driven shaft and on which the associated trowel blades are mounted, and wherein the trowel blades of each of said rotor assemblies are mountable on multiple axial locations on the associated support blades so as to alter the diameter of the associated circular area.

19. A finishing trowel as defined in claim 16, wherein said finishing trowel is a riding trowel having two rotor assemblies.

20. A method of driving a rotor assembly of a concrete finishing trowel having a mobile frame on which said rotor assembly is mounted and, said rotor assembly including 1) a driven shaft extending downwardly from said frame, and 2) a plurality of trowel blades attached to and extending outwardly from said driven shaft so as to rest on a surface to be finished and to rotate with said driven shaft, said method comprising:

(A) transferring torque from a power source to a flexible shaft which is flexible along at least a substantial portion of an entire length thereof;

(B) transferring torque from said flexible shaft to said driven shaft so as to rotate said driven shaft and to finish a circular area and during the transfer of torque from said flexible shaft to said driven shaft; and (C) repeatedly tilting said driven shaft with respect to said frame, thereby causing said flexible shaft to dynamically and repeatedly bend during torque transfer.

21. A method as defined in claim 20, further comprising permitting axial movement between said flexible shaft and at least one of an output shaft and said driven shaft during the tilting step.

22. A method as defined in claim 20, wherein said flexible shaft bends through an angle of between 3° and 5° during said tilting step.

23. A method as defined in claim 20, further comprising first performing a floating operation by operating said power source so as to drive said rotor assembly to rotate at a speed of less than 50 rpm over substantially an entire surface to be finished, and then performing a burning operation by operating said power source so as to drive said rotor assembly to rotate at a speed of more than 150 rpm over substantially the entire surface to be finished.

24. A method as defined in claim 23, wherein, during said floating operation, said rotor assembly is rotated at a speed of about 30 rpm and, during said burning operation, said rotor assembly is rotated at a speed of about 200 rpm.

25. A method as defined in claim 20, wherein said step of transferring torque from said power source to said flexible shaft comprises (A) driving a main centrifugal clutch from an output shaft;

(B) driving a secondary centrifugal clutch from said main centrifugal clutch; and (C) driving said flexible shaft from said secondary centrifugal clutch, wherein each of said clutches has a variable-width sheave which changes in effective width as a rotational speed thereof increases, thereby increasing a speed ratio between said clutches as the speed of said output shaft increases.

26. A method as defined in claim 20, further comprising (A) actuating a controller to generate an electric signal indicative of a desired steering command;

(B) transmitting said signal from said controller to at least one electric actuator; and (C) in response to receipt of said signal, energizing said actuator to tilt said driven shaft so as to steer said finishing trowel.

27. A method as defined in claim 20, further comprising moving said blades of said rotor assembly radially relative to said driven shaft to alter a diameter of said circular area.

28. A method of driving left and right rotor assemblies of a riding concrete finishing trowel having 1) a mobile frame on which said rotor assemblies are mounted, and 2) an operator's platform mounted on said frame between said left and right rotor assemblies, each of said rotor assemblies including 1) a gearbox supported on said frame and driving a driven shaft extending downwardly from said frame, and 2) a plurality of trowel blades attached to and extending outwardly from said driven shaft so as to rest on a surface to be finished and to rotate with said driven shaft, said method comprising:

(A) transferring torque from an engine to an output shaft;

(B) transferring torque from said output shaft to a drive clutch of a torque converter assembly;

(C) transferring torque from said drive centrifugal clutch to a driven clutch of said torque converter assembly, wherein each of said clutches has a variable-width sheave which changes in effective width as a rotational speed thereof increases, thereby increasing a speed ratio between said clutches as the speed of said output shaft increases;

(D) transferring torque from said driven clutch to a jackshaft and from said jackshaft to left and right flexible shafts, each of which is flexible along at least a substantial portion of an entire length thereof;

(E) transferring torque from each of said left and right flexible shafts to an input shaft of the associated gearbox and from the associated gearbox to the associated driven shaft so as to rotate the associated driven shaft;

(F) repeatedly tilting said gearboxes with respect to said frame, thereby causing said flexible shafts to dynamically and repeatedly bend through an angle of about 3° to about 5° during torque transfer while permitting axial movement between each of said flexible shafts and at least one of the said jackshaft and the input shaft of the associated gearbox; and (G) first performing a floating finishing operation by operating said engine so as to drive each of said rotor assemblies to rotate at a speed of less than 50 rpm over substantially an entire surface to be finished, and then performing a burning operation by operating said engine so as to drive each of said rotor assemblies to rotate at a speed of more than 150 rpm over substantially the entire surface to be finished.

29. A riding concrete finishing trowel comprising:

(A) a mobile frame having an upper deck;

(B) an operator's platform mounted on said deck;

(C) a plurality of rotor assemblies, each of which includes a gearbox which is supported on said frame, a driven shaft extending downwardly from said gearbox, and a plurality of trowel blades attached to and extending outwardly from said driven shaft so as to rest on a surface to be finished and to rotate with said driven shaft; a power source which is supported on said frame and which has a rotatable output shaft; and (D) a torque transfer system which transfers torque from said output shaft to each of said driven shafts, said torque transfer system including, for each of said rotor assemblies, a flexible shaft which has an input end operatively coupled to said output shaft and an output end which is operatively coupled to the associated driven shaft, said flexible shaft being flexible through at least a substantial portion of an entire length thereof to accommodate bending thereof relative to the input end thereof upon a steering operation which results in tilting of the associated driven shaft.

30. A finishing trowel as defined in claim 29, wherein said operator's platform is hingedly attached to said deck to permit access to components of said finishing trowel located thereunder.

31. A finishing trowel as defined in claim 29, wherein said torque transfer system further comprises a torque converter including a drive clutch coupled to said output shaft, a driven clutch coupled to said input of said flexible shaft, and a belt coupling said drive clutch to said driven clutch, wherein each of said clutches has a variable-width sheave which changes in effective diameter as a rotational speed thereof increases.

* * * * *